US008175301B2

(12) United States Patent
Salehi

(10) Patent No.: US 8,175,301 B2
(45) Date of Patent: May 8, 2012

(54) LOUDSPEAKER DRIVER

(76) Inventor: Kourosh Salehi, New York, NY (US)

( * ) Notice: Subject to any disclaimer, the term of this patent is extended or adjusted under 35 U.S.C. 154(b) by 563 days.

(21) Appl. No.: 12/322,969

(22) Filed: Feb. 9, 2009

(65) Prior Publication Data

US 2009/0252369 A1 Oct. 8, 2009

Related U.S. Application Data

(63) Continuation-in-part of application No. 11/732,393, filed on Apr. 3, 2007, now Pat. No. 7,515,724.

(60) Provisional application No. 60/789,256, filed on Apr. 5, 2006, provisional application No. 60/875,089, filed on Dec. 15, 2006, provisional application No. 61/063,881, filed on Feb. 7, 2008, provisional application No. 61/192,968, filed on Sep. 23, 2008.

(51) Int. Cl.
*H04R 25/00* (2006.01)

(52) U.S. Cl. ..... 381/182; 381/398; 381/186

(58) Field of Classification Search ..... 381/152, 381/182, 186, 386, 398, 400, 401, 402, 403, 381/404, 421, 423, 424, 432; 181/144, 147, 181/163, 171, 172

See application file for complete search history.

(56) References Cited

U.S. PATENT DOCUMENTS

| | | | | |
|---|---|---|---|---|
| 2,551,556 | A | 5/1951 | Brennan | 181/164 |
| 3,125,647 | A | 3/1964 | Rouy | 381/432 |
| 4,590,333 | A | 5/1986 | Strohbeen | 381/186 |
| 5,073,946 | A | 12/1991 | Satoh et al. | 381/349 |
| 5,295,194 | A | 3/1994 | Christensen | 381/190 |
| 5,604,815 | A | 2/1997 | Paddock | 381/396 |
| 5,682,436 | A | 10/1997 | Sakamoto et al. | 381/408 |
| 5,841,880 | A | 11/1998 | Sakamoto | 381/401 |
| 6,236,733 | B1 * | 5/2001 | Kato et al. | 381/423 |
| 6,496,586 | B1 | 12/2002 | Hayes et al. | 381/152 |
| 6,973,194 | B2 | 12/2005 | Iwasa et al. | 381/412 |
| 7,197,154 | B2 * | 3/2007 | Sahyoun | 381/404 |
| 7,515,724 | B2 | 4/2009 | Salehi | 381/182 |
| 2004/0202347 | A1 | 10/2004 | Koike | 381/431 |
| 2005/0286729 | A1 | 12/2005 | Harwood et al. | 381/152 |
| 2007/0286439 | A1 | 12/2007 | Salehi | 381/182 |

OTHER PUBLICATIONS

International Search Report mailed Oct. 2, 2008.

* cited by examiner

*Primary Examiner* — Huyen D Le

(57) ABSTRACT

A loudspeaker driver that includes a suspended diaphragm and at least one voice coil disposed lateral to the suspended diaphragm, suspended in a magnetic field and coupled to the diaphragm.

14 Claims, 38 Drawing Sheets

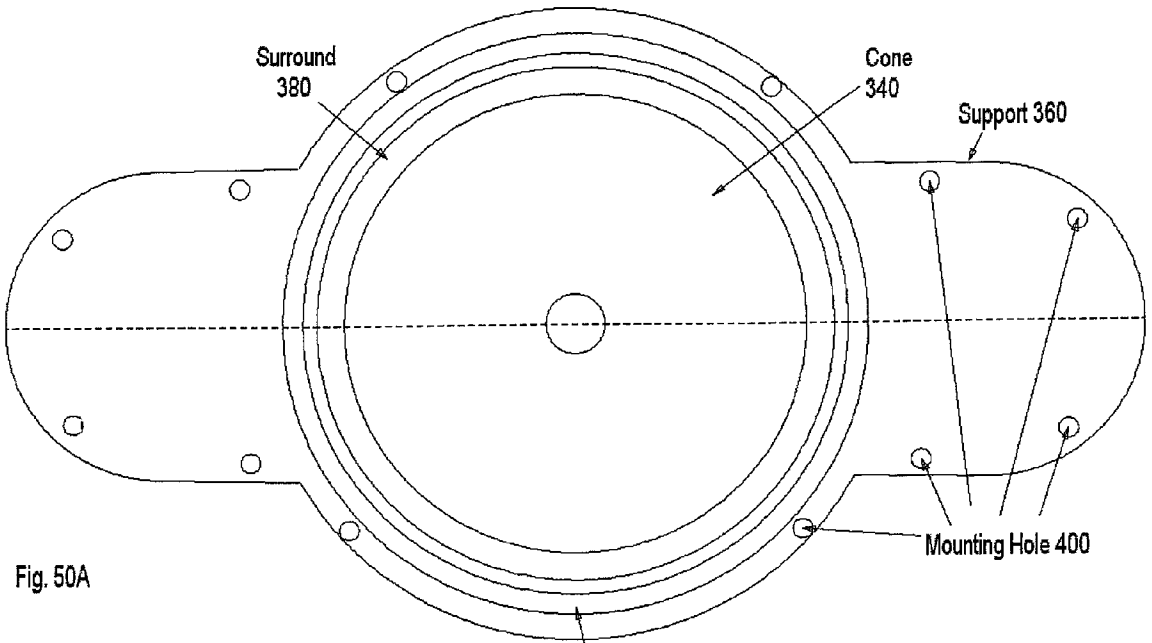
Fig. 50A
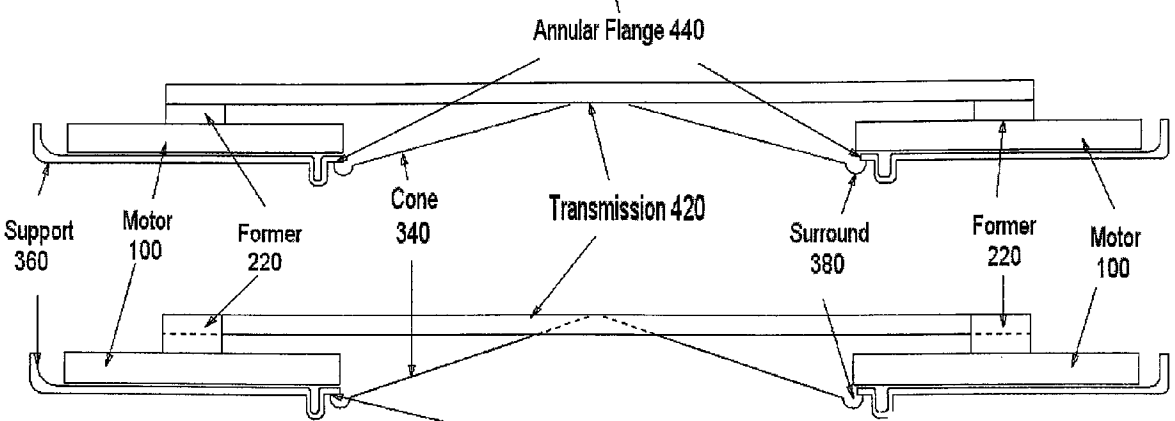
Fig. 50B
Fig. 50C

LOUDSPEAKER DRIVER

CLAIM OF PRIORITY AND CROSS-REFERENCE

The present application claims priority to U.S. patent application Ser. No. 11/732,393, entitled Loudspeaker Driver, which claims priority to U.S. Provisional Patent Application No. 60/789,256, entitled Electronic Presentation System and Method & Loudspeaker, to Kourosh Salehi et al. filed on Apr. 5, 2006, the entire disclosure of which is incorporated by reference, and also claims priority to U.S. Provisional Application No. 60/875,089, entitled Multi-motor Loudspeaker Driver to Kourosh Salehi filed on Dec. 15, 2006, the entire disclosure of which is incorporated by reference. The present application further claims priority to and incorporates by reference the entire content of U.S. Provisional Patent Application No. 61/063,881, entitled Loudspeaker Driver, to Kourosh Salehi, filed Feb. 7, 2008, and claims priority to and incorporates by reference U.S. Provisional Patent Application No. 61/192,968, entitled Loudspeaker Driver, to Kourosh Salehi, filed Sep. 23, 2008.

BACKGROUND OF THE INVENTION

Referring to FIG. 1, a typical loudspeaker driver includes a cone-shaped diaphragm 1 that is movably suspended (using a surround 6 or the like) in a basket 2 for motion along central axis thereof, and a single motor 3 mounted on the basket that includes a voice coil 4 having a central axis 5 in substantial alignment with the central axis of diaphragm 1, which is coupled directly to the back of diaphragm 1 in order to move the diaphragm axially in response to an AC signal.

It is well known that as the size of the diaphragm increases and/or when more power is desired the size of the magnet required for driving the voice coil increases. Also, as the size of the diaphragm increases the size of the basket is increased, which in turn increases the profile (i.e. the front to back thickness) of the driver. Thus, woofers (drivers used for reproducing sound in the bass range, e.g. 20 Hz to 3000 Hz), which typically include larger diaphragms (compared to tweeters), require large motors and typically have larger profiles.

The profile of the driver directly affects the size of the speaker cabinet that receives the driver. A speaker cabinet that receives a woofer, therefore, requires a relatively large cabinet having a relatively large profile (i.e. front to back thickness).

SUMMARY OF THE INVENTION

It is an object of the present invention to provide a loudspeaker driver.

In one group of embodiments according to the present invention, a loudspeaker driver includes a movable diaphragm having an open mouth defined by a terminal boundary residing at its outermost lateral edge and surrounding the entire interior surface area thereof, and a plurality of driver arrangements each including a voice coil suspended in a magnetic field, mechanically coupled to the movable diaphragm and disposed lateral to its outermost lateral edge.

Because of the arrangement in a loudspeaker driver according to the present invention, the diameter of the open mouth of the diaphragm does not necessarily lead to the enlargement of the profile (i.e. the front to back depth) of the driver.

Moreover, multiple motors of lower power rating each including a smaller magnet compared to a single motor having a power rating equal to the total power of the multiple motors can be used, which may lead to the reduction in the cost of a loudspeaker driver for a given power rating.

In another group of embodiments according to the present invention, a loudspeaker driver according to the present invention includes a plurality of movable diaphragms each having an open mouth defined by a terminal boundary residing at its outermost lateral edge and surrounding the entire interior surface area thereof, and at least one driver arrangements including a voice coil suspended in a magnetic field, mechanically coupled to the movable diaphragms and disposed therebetween lateral to the outermost lateral edge thereof.

Other features and advantages of the present invention will become apparent from the following description of the invention which refers to the accompanying drawings.

BRIEF DESCRIPTION OF THE FIGURES

FIG. 50A shows a front plan view of a driver according to another embodiment of the present invention.

FIG. 50B shows a cross-sectional view of a driver according to a variation of the embodiment shown by FIG. 50A along the broken line in FIG. 50A.

FIG. 50C shows a cross-sectional view of a driver according to a variation of the embodiment shown by FIG. 50A along the broken line in FIG. 50A.

DESCRIPTION OF THE EMBODIMENTS

Figure 1:
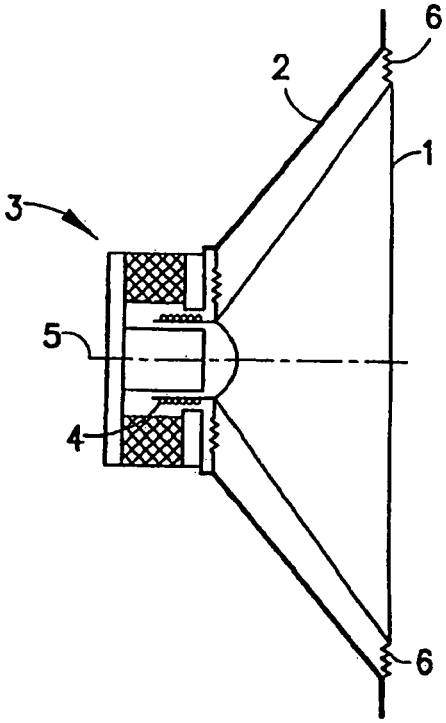
FIG.1 PRIOR ART
FIG. 1 illustrates a loudspeaker driver according to the prior art.

Unless otherwise indicated, it is intended for like numerals to identify like features in each embodiment disclosed herein. In the interest of brevity and efficiency in disclosing the invention like features are not repeatedly described. The presence of like features in each embodiment is clear, however, by reference numerals and the general appearance of like features in the attached figures.

Figure 2A:
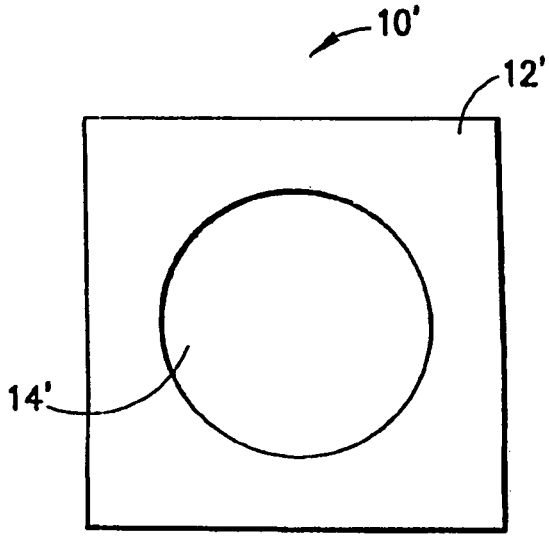
FIG. 2A is a front view of a speaker cabinet that includes a loudspeaker driver according to the present invention.
Figure 2B:
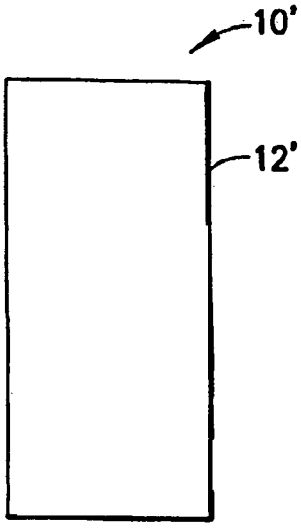
FIG. 2B is a side view of the speaker cabinet of FIG. 2A.

Referring to FIGS. 2A and 2B, a loudspeaker that includes a loudspeaker driver according to the present invention includes a speaker cabinet 10' having a front board 12' with a sound hole 14'. Cabinet 10' may be fully or partially enclosed. Specifically, speaker cabinet 10' may be an acoustic suspension speaker cabinet (fully enclosed) or a ported acoustic suspension cabinet, or the like. Cabinet 10' may be fabricated with medium density fiberboard (MDF), particle board, or any other suitable material.

Figure 3A:
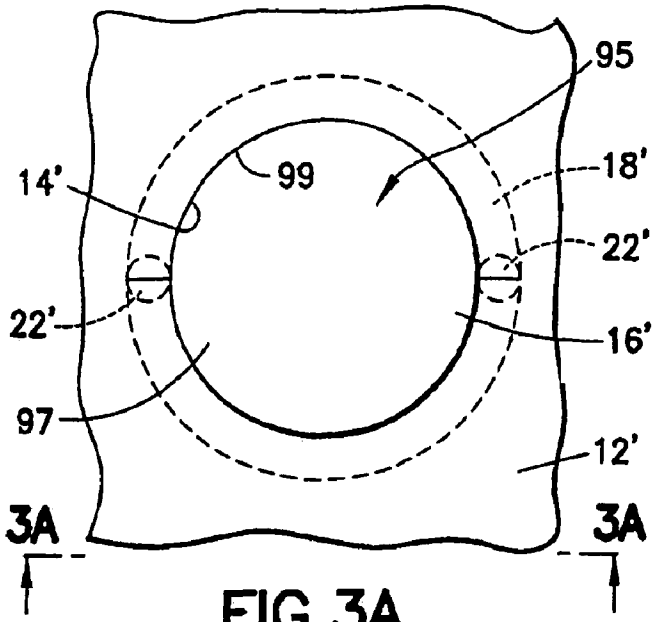
FIG. 3A shows a front (facing the outside of the cabinet) of a loudspeaker driver according to the first embodiment of the present invention.
Figure 3B:
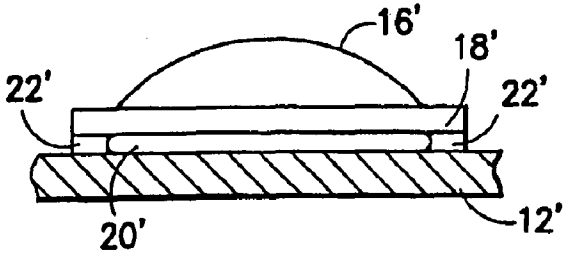
FIG. 3B shows a side view of the driver shown in FIG. 3A as seen along line 3A-3A in the direction of the arrows.
Figure 5C:
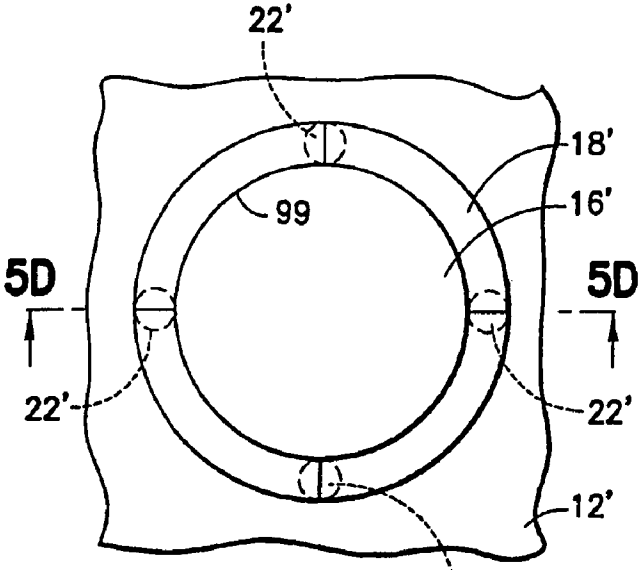
FIG. 5C shows a back (facing the interior of the cabinet) of the loudspeaker driver according to the second embodiment.
Figure 5D:
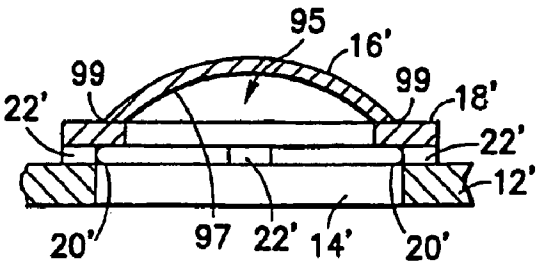
FIG. 5D is a cross-sectional view along line 5D-5D in FIG. 5C seen in the direction of the arrows.
Figure 3C:
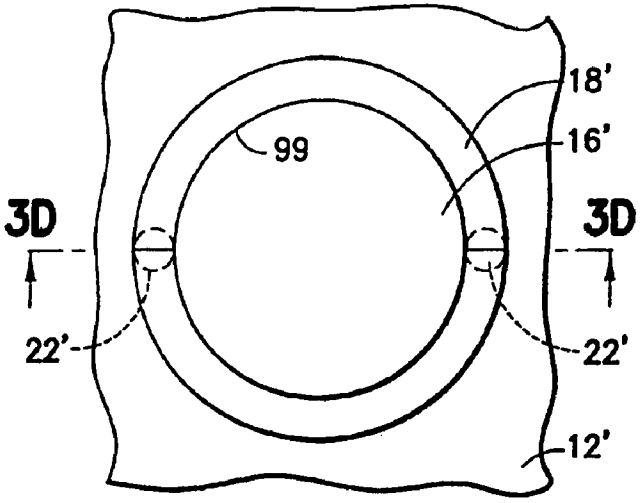
FIG. 3C shows a back (facing the interior of the cabinet) of a loudspeaker driver according to the first embodiment.
Figure 3D:
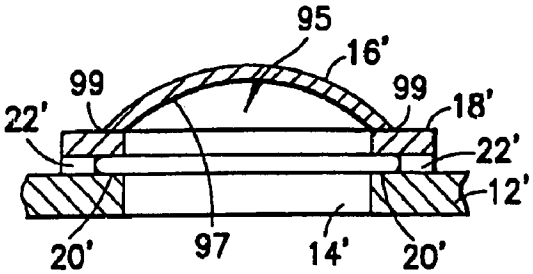
FIG. 3D is a cross-sectional view along line 3D-3D in FIG. 3C seen in the direction of the arrows.

Referring to FIGS. 3A and 3B, a loudspeaker driver according to the first embodiment of the present invention includes a diaphragm portion 16', a transmission portion (transmission frame) 18', which is preferably a ring, coupled to and disposed around the outer perimeter at the open mouth (described below) of diaphragm 16', a suspension member 20' which is fixed to the back side (the side facing the interior of cabinet 10') of front board 12' (serving as a support body) and transmission portion 18', and a plurality of preferably oppositely disposed drivers 22' each driver 22' being coupled between the backside of front board 12' and transmission portion 18'. The function of each driver 22' is to drive transmission portion 18' in a direction that is essentially perpendicular to front board 12'. Each driver 22' may be a transducer or a motor that includes a voice coil suspended in a magnetic field provided by a magnet, which may receive an electronic signal from a signal source such as an audio amplifier. Note that for the sake of simplicity the signal wires of the voice coils are not shown.

Figure 4A:
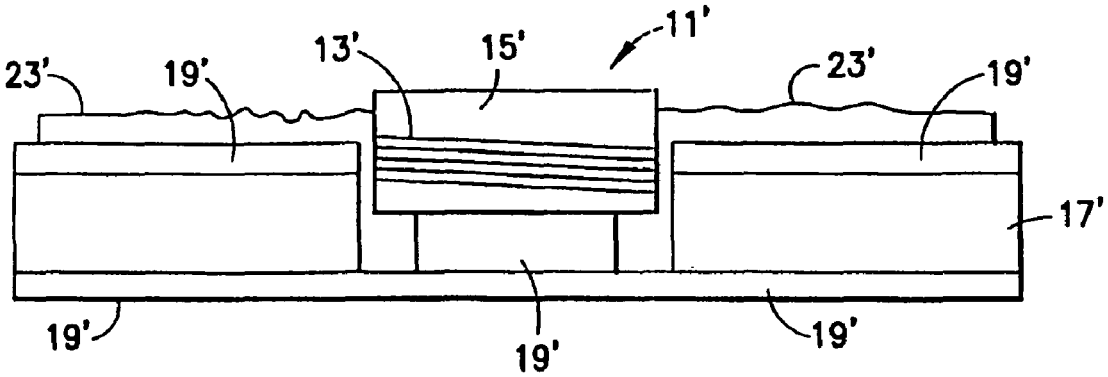
FIG. 4A shows an example of a motor arrangement for driving a voice coil in a loudspeaker driver according to the present invention.
Figure 4B:
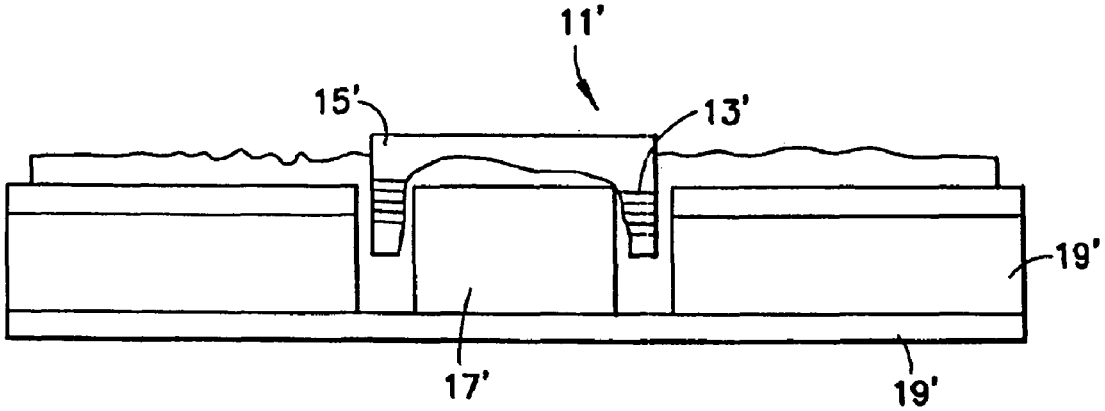
FIG. 4B shows another example of a motor arrangement for driving a voice coil in a loudspeaker driver according to the present invention.

Referring to FIGS. 4A and 4B, in the preferred embodiment, a voice coil arrangement suspended in a magnetic field is used as a driver 22'. Each voice coil 11' arrangement may be the same as those used in conventional loudspeaker drivers. Each voice coil 11', for example, includes a voice coil wire 13' that is wrapped around a bobbin 15' which can be induced to move by an AC signal when suspended in the magnetic field of a permanent magnet 17' projected by a magnetic circuit formed by metallic bodies 19' coupled to permanent magnet 17' similar to a conventional loudspeaker motor. Permanent magnet 17' is preferably coupled (directly or indirectly) to the back side (the surface facing the interior of the cabinet) of front board 12', and bobbin 15' of voice coil 11' may be attached to transmission portion 18', whereby voice coil 11' is suspended (in mid air) in the vicinity of and in the magnetic field of permanent magnet 17'. When operating, the electronic signals are transmitted to voice coil 11', which results in voice coil 11' being pushed away, or pulled toward permanent magnet 17'. Permanent magnet 17' may include an opening wide enough to receive the voice coil therein (FIG. 4A), or alternately, bobbin 15' may have an opening wide enough to receive magnet 17' (FIG. 4B). Note that each driver 22' may further include a spider 23' disposed around and coupled to voice coil 11' and attached to front board 12' or a metallic body 19' for additional stability.

Each voice coil 11' is suspended in mid air because of suspension 20'. Specifically, suspension 20' attaches transmission portion 18' to the back side of front board 12' such that the concave surface of diaphragm 16' faces outwardly (outside of cabinet 10') through sound hole 14'. Preferably, suspension 20' is disposed around sound hole 14' completely to prevent air from escaping cabinet 10'. Note that suspension 20' should be rigid enough so that it does not sag substantially under the weight of transmission portion 18', diaphragm 16', and voice coils 11'. However, diaphragm 16' should be compliant enough so that it will allow movement of transmission portion 18'. One suitable body for suspension 20' may be an incomplete tube (a tube which has a portion thereof removed lengthwise) made from a flexible polymer such as silicone. A full tube may also work if it satisfies the criteria set forth above. Other suspension materials used in conventional loudspeakers may also be used without deviating from the scope and the spirit of the present invention. Such conventional suspensions are typically made from paper based materials, reinforced fabric or foam.

Note that diaphragm 16' is shown to be a semisphere (not quite a hemisphere) having preferably a circular open mouth (as defined below) the circumference of which is the outer perimeter that is fixed to transmission portion 18'. Diaphragm 16' may be made from a paper based material used for forming conventional diaphragms. It has also been found that Styrofoam based materials may be suitable. Note that transmission portion 18' may be made of the same material as diaphragm 16'. That is, diaphragm 16' and transmission portion 18' may be a unitary body. For example, as shown, transmission portion 18' may flange outwardly from the circumference of the mouth of diaphragm 16'. Transmission portion 18' and diaphragm 16' may be made from different materials and fixed to one another using any suitable method—for example, adhesively joined—without deviating from the scope and the spirit of the present invention. Note that the joint between diaphragm 16' and transmission portion 18' does not allow free flow of air to ensure air is pushed efficiently by diaphragm 16'.

Note further that drivers 22' are preferably aligned along the diameter of the circular mouth of diaphragm 16' in order to ensure even movement of diaphragm 16' along an axis that is perpendicular to front board 12'.

Figure 4C:
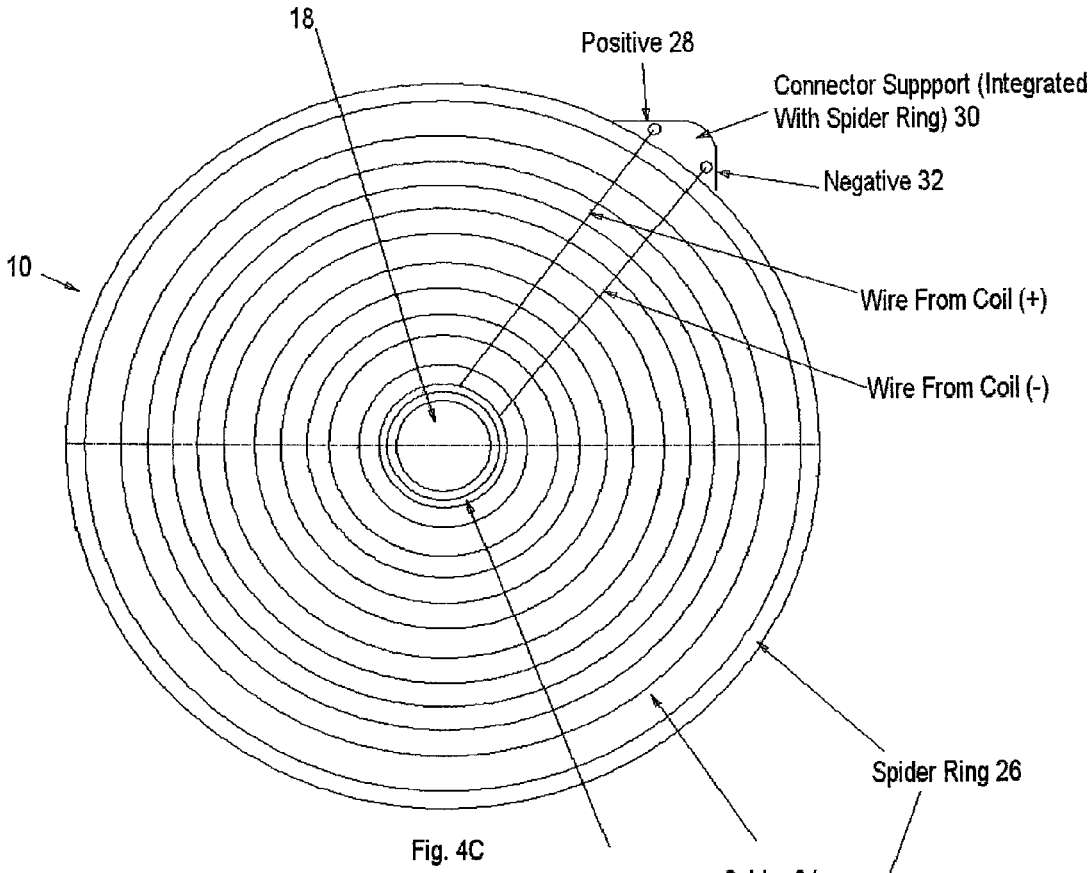
FIG. 4C shows a top plan view of a motor used in a driver according to another embodiment of the present invention.
Figure 4D:
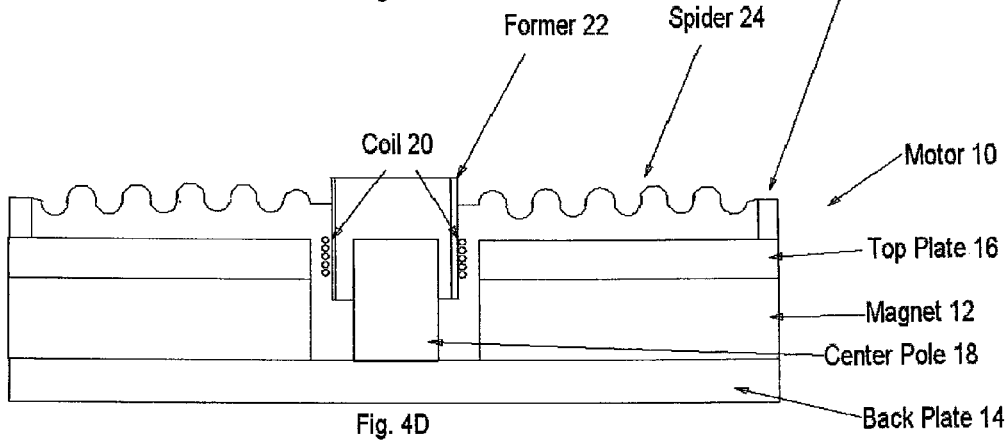
FIG. 4D shows a cross-sectional view of a motor used in a driver according to the present invention as shown by FIG. 4C along the broken like shown therein.

Alternatively, each loudspeaker driver according to the present invention could include one or a plurality (at least two) motors as depicted by FIGS. 4C and 4D. Each motor 100 in the preferred embodiment could include a donut-shaped magnet 120 (i.e. a disk having a central hole therein), a back plate 140 comprised of a suitable metallic material coupled to one surface (back surface) of magnet 120 and preferably closing the hole therein, a donut-shaped top plate 160 coupled to another opposing surface of magnet 120 (front surface)

also comprised of a suitable metallic material having a hole therein in registration with the hole in magnet 120, and a center pole piece 180 formed with a suitable metallic material extending from back plate 140 through the hole in magnet 120 and reaching through at least the hole in top plate 160 to form a magnetic circuit. Each motor 100 further includes a coil 200 wrapped around a cylindrical former 220. Former 220 is coupled to the center of a spider 240 such that coil 200 is suspended between at least top plate 160 and center pole piece 180. The outer periphery of spider 240 is coupled to a spider ring 260 which is in turn coupled to top plate 160 whereby spider 240 is secured in place. Spider ring 260 can be a metallic ring the height of which can be used to set how far former 220 can move axially, and thus how far coil 200 can move axially in response to the signal it receives. The positive end of coil 200 is coupled to a positive connector 280 residing on a connector support plate 300, which is preferably integral with spider ring 260, and negative end of coil 200 is coupled to negative connector 320 residing on connector support plate 300. Positive and negative connectors 280, 320 are then used for connection to an external signal source.

Figure 5A:
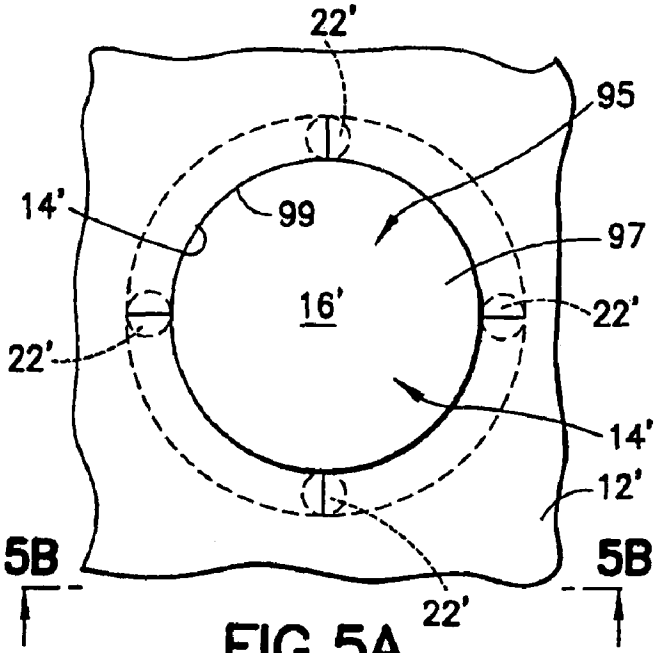
FIG. 5A shows a front (facing the outside of the cabinet) of a loudspeaker driver according to the second embodiment of the present invention.
Figure 5B:
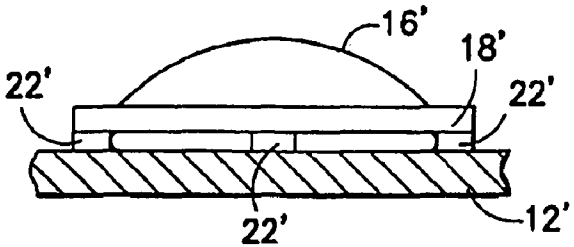
FIG. 5B shows a side view of the loudspeaker driver shown in FIG. 5A as seen along line 5B-5B in the direction of the arrows.

Referring now to FIGS. 5A and 5B, in a second embodiment of the present invention, four drivers 22' are used instead of two. Each pair of drivers 22' lie along a diameter of the circular base (open mouth as defined below) of diaphragm 16'. Also, drivers 22' are evenly spaced angularly (ninety degree apart in this case) in order to ensure even driving movement of diaphragm 16'.

Note that a speaker arrangement according to the present invention is not limited to two or four drivers 22', and that three drivers 22' or more than four drivers 22' can be added as needed without deviating from the scope and the spirit of the present invention.

Figure 6B:
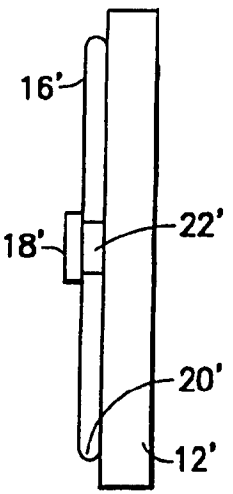
FIG. 6B is a side view along line 6B-6B in the direction of the arrows.
Figure 6A:
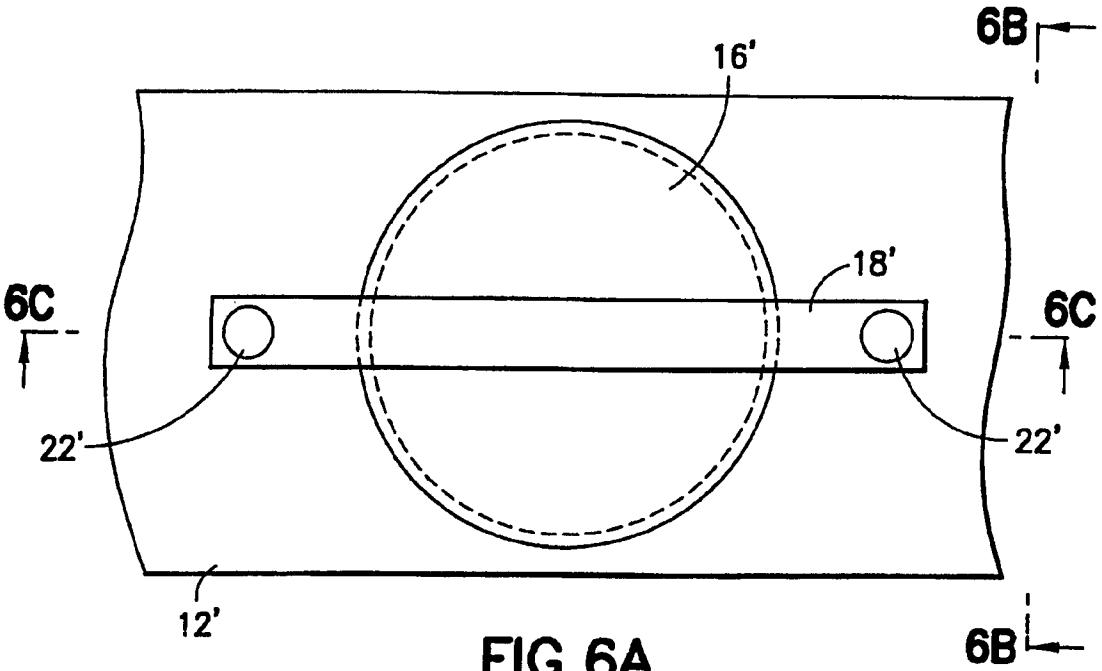
FIG. 6A shows a back view of a loudspeaker driver according to the third embodiment.
Figure 6C:
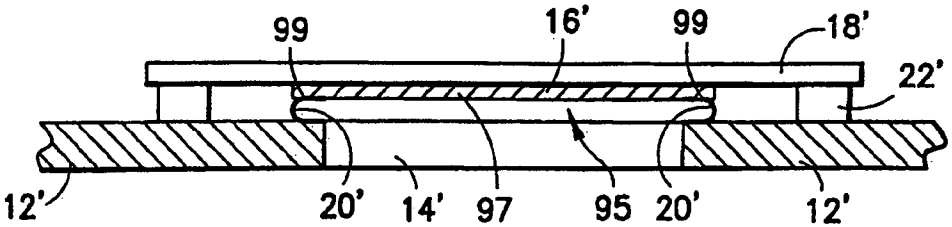
FIG. 6C is a cross-sectional view along line 6C-6C in the direction of the arrows.

Referring to FIGS. 6A-6C, in a third embodiment of the present invention, a transmission portion 18' is attached to the back of diaphragm 16', and each driver 22' is attached to either end of transmission portion 18'. In this embodiment, transmission frame 18' is an elongated rigid body that is capable of transmitting motion from drivers 22' to the back of diaphragm 16'. In alternative embodiments more than two drivers 22' can be used. For example, a cross-shaped transmission frame 18' may be used with four drivers 22' each disposed at a free end of the cross.

Figure 7:
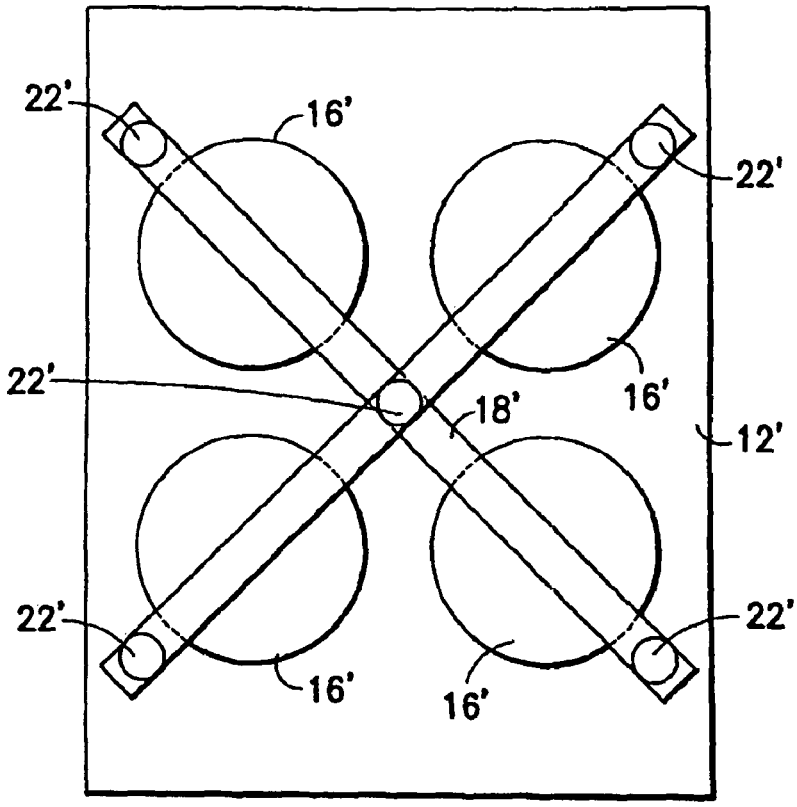
FIG. 7 is a back view of a loudspeaker driver according to the fourth embodiment.

Referring to FIG. 7, in a fourth embodiment, transmission portion 18' may be a cross-shaped body that is attached to the back of a plurality of diaphragms 16' (illustrated in abstract by a cross-like marking) and driven by a plurality of drivers 22' as shown.

Figure 8:
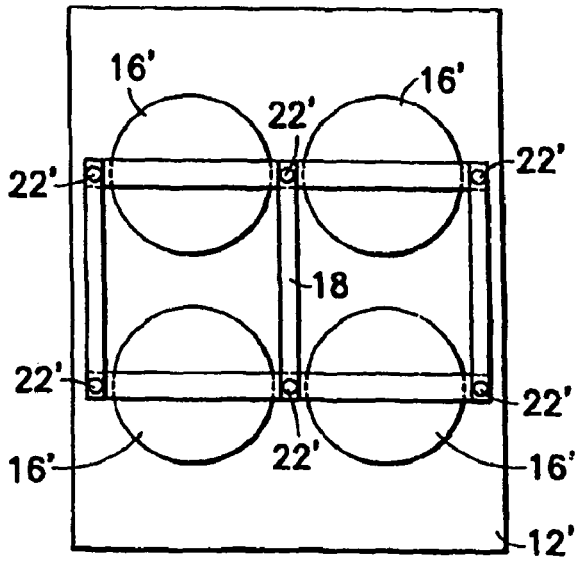
FIG. 8 is a back view of a loudspeaker driver according to the fifth embodiment.

Referring to FIG. 8, in a fifth embodiment of the present invention, transmission portion 18' is a lattice-shaped body that is attached to the back of a plurality of diaphragms 16', and driven by a plurality of drivers 22'.

A speaker arrangement according to the present invention is advantageous in that it can have a plurality of lower power rated drivers delivering the same power as a higher power rated speaker. For example, two 25 watt drivers can be used to replace a 50 watt driver.

Furthermore, due to the multi-driver arrangement, it is now possible to turn some of the drivers off or on selectively. Thus, the speaker power rating can be changed as desired.

It should be noted that drivers 22' and suspension 20' need not be mounted on front board 12' directly. Rather, a flat board or the like may be provided as a platform for receiving drivers 22' and suspension 20' and the board can then be mounted on the back surface of front board 12'. The board should include an opening that coincides with sound hole 14'.

It should also be noted that a loudspeaker driver according to the present invention is not limited to a cabinet environment, but may be adapted to other enclosures without deviating from the scope and the spirit of the present invention.

The voice coils in a loudspeaker driver according to the present invention may be series connected or parallel connected and connected together to a single AC source in order to operate in unison. Alternatively, one or more of the voice coils can be connected to a different AC source than the others, whereby the voice coils can be operated independently.

Figure 9:
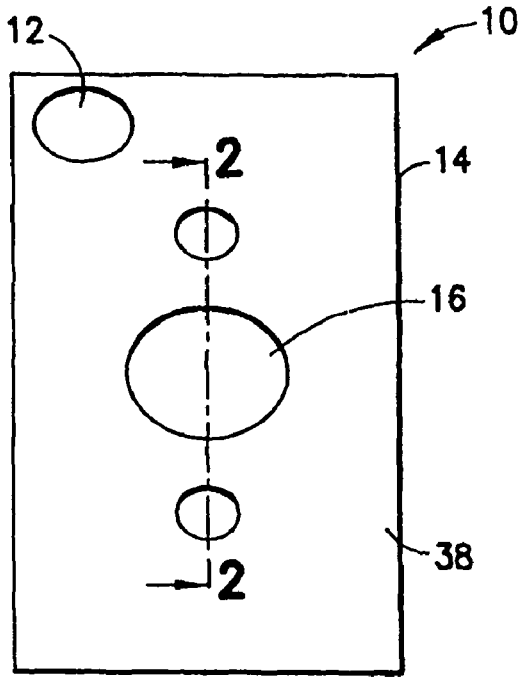
FIG. 9 illustrates a front plan view of another loudspeaker that includes a loudspeaker driver according to the present invention.

FIG. 9 illustrates a front plan view of a loudspeaker 10 that includes a loudspeaker driver arrangement according to the fifth embodiment of the present invention. For illustrative purposes loudspeaker 10 is a two way system that includes a tweeter 12 as well as a loudspeaker driver according to the present invention mounted in a closed cabinet 14. It should be understood that a loudspeaker according to the present invention is not limited to two way systems, but may be a three way system or only include a loudspeaker driver according to the present invention. Furthermore, a loudspeaker according to the present invention is not limited to sealed cabinet type arrangements, but may be implemented in other arrangements, for example, ported cabinets.

Figure 10A:
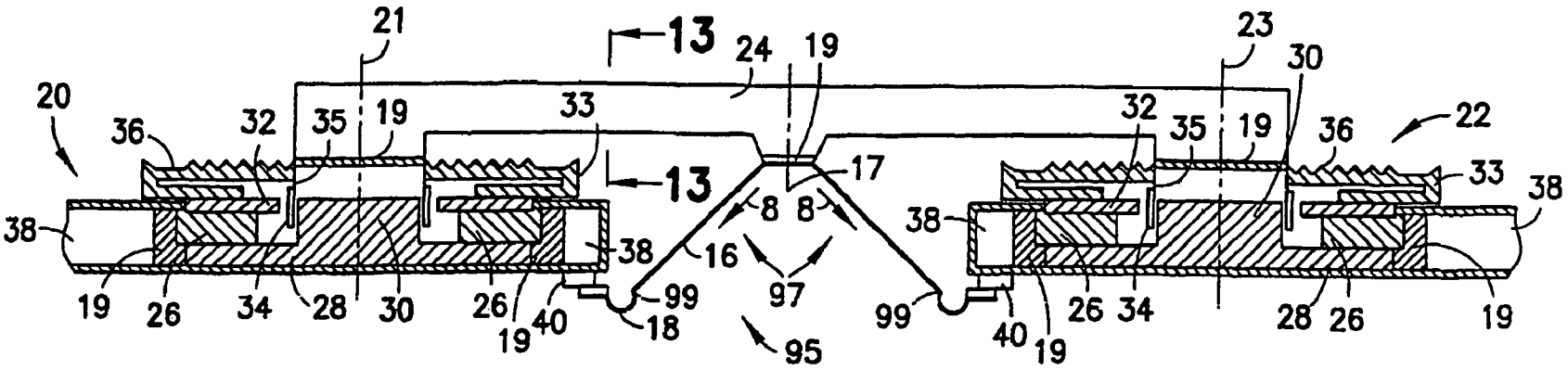
FIG. 10A illustrates a cross-sectional view of a loudspeaker driver according to an embodiment of the present invention as would be seen along line 2-2 viewed in the direction of the arrows.

Referring to FIG. 10A, which illustrates a cross-sectional view of a driver according to the present invention as would be seen along line 2-2, a loudspeaker driver according to the present invention includes a diaphragm 16 received in a diaphragm opening in front board 38 (serving as a support body) of cabinet 14, which is cone-shaped and made from any appropriate material such as paper, a surround 18, two motors 20, 22, and a transmission frame 24 operatively coupled to motors 20, 22 and diaphragm 16, whereby diaphragm 16 can be moved along its central axis 17 in order to generate sound waves.

According to one aspect of the present invention, each motor 20, 22 is disposed lateral to and outside the outer boundaries of diaphragm 16. Preferably, the axis of motion 21, 23 of each motor 20, 22 is parallel to the central axis 17 of diaphragm 16.

Each motor 20,22 preferably includes a magnet 26, a back plate 28, a center pole piece 30 extending through a central opening in magnet 26, a top plate 32, a coil 34 wound around a former (bobbin) 35, and a spider 36. Spider 36 includes a central opening which receives and is coupled to former 35 and is secured to top plate 32 directly or indirectly (through a base plate 33 attached to top plate 32), whereby coil 34 is suspended in the magnetic field present in the gap between a top portion of pole piece 30 and top plate 32. Each motor 20, 22 operates in the conventional manner. That is, by applying an AC signal to a coil 34, coil 34 and former 35 move along motion axis 20,23 of the motor.

According to one aspect of the present invention, each end of transmission frame 24 is mechanically secured to a former 35 through an adhesive body 19 formed with, for example, an epoxy glue, and a middle portion of transmission frame 24 is mechanically secured to a central portion of the back of (the surface facing the interior of cabinet 12) diaphragm 16 also through an adhesive body formed with, for example, epoxy glue or the like.

In this embodiment of the present invention, each motor 20,22 is received in a respective opening in the front board 38 of cabinet 12 and mechanically secured to front board 38. One preferred way to secure each motor 20, 22 is through the use of an adhesive such as glue. Further, note that in this embodiment each motor 20,22 is exposed through a respective opening in front board 38. Preferably, the back of each motor 20, 22 is coplanar with the front surface (the surface of the exterior of front board 38) of front board 38 as illustrated by FIG. 10A.

Figure 10B:
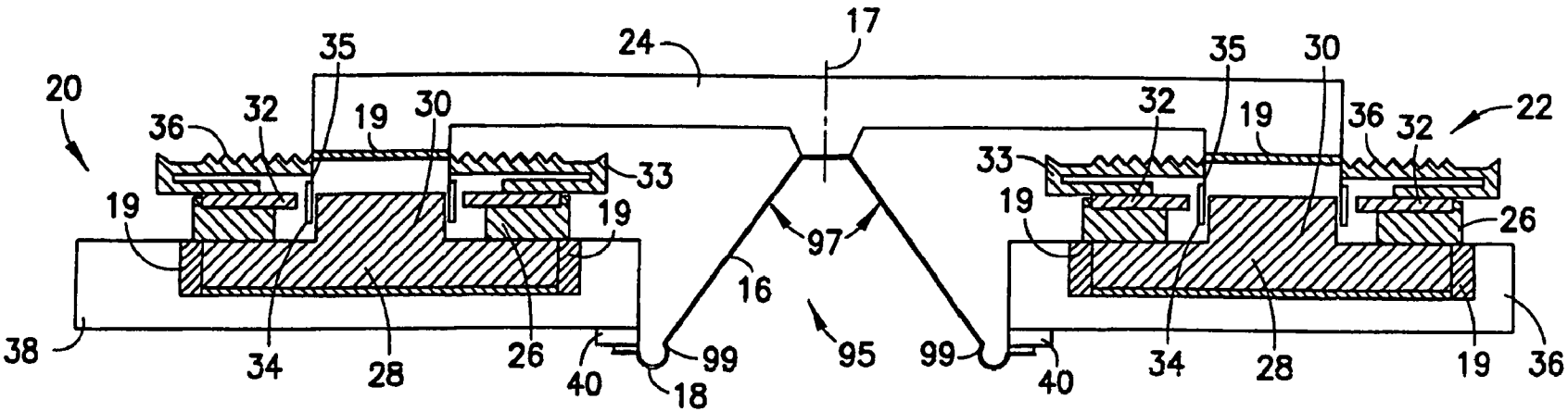
FIG. 10B illustrates a cross-sectional view of a loudspeaker driver according to an embodiment of the present invention as would be seen along line 2-2 viewed in the direction of the arrows.

Referring to FIG. 10B, note that it may not be necessary to have a through opening in front board 38 for receiving a motor, and each motor 20, 22 may be received instead in a respective recess (which extends only partially through the body of front board 38) in front board 38 and then secured to front board 38 with glue 19 or the like without deviating from the scope and spirit of the present invention.

In the first variation of the fifth embodiment, surround 18 is adhesively attached to a frame 40. Frame 40 is then secured to front face of front board 38 with screws or the like mounting hardware. Frame 40 is preferably a metallic or plastic ring which receives in the interior opening thereof diaphragm 16, and is attached to front face of the front board 38 by screws or the like.

Figure 11A:
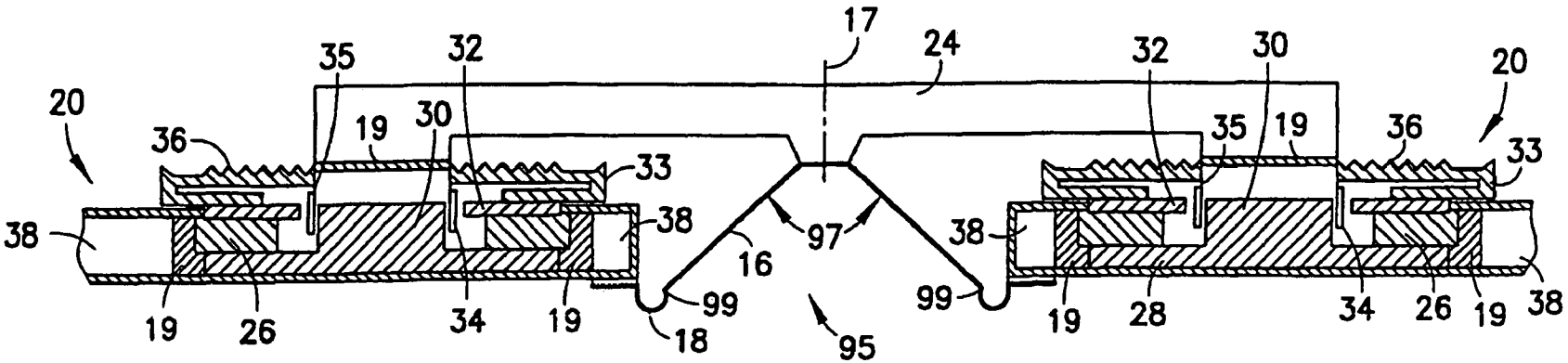
FIG. 11A illustrates a cross-sectional view of a loudspeaker driver according to an embodiment of the present invention as would be seen along line 2-2 viewed in the direction of the arrows.
Figure 11B:
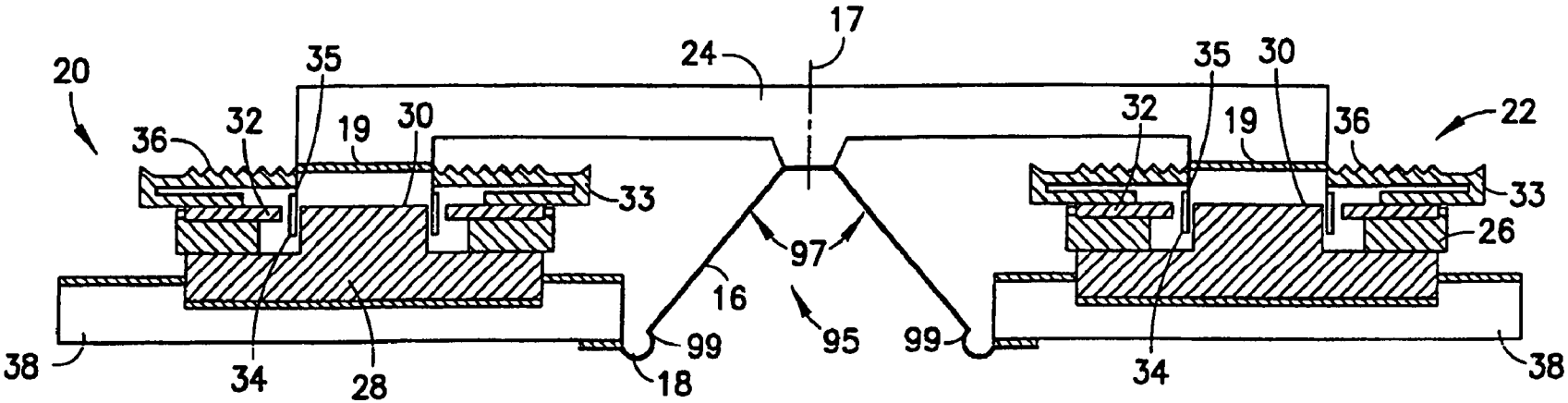
FIG. 11B illustrates a cross-sectional view of a loudspeaker driver according to an embodiment of the present invention as would be seen along line 2-2 viewed in the direction of the arrows.

Referring to FIG. 11A, which illustrates another variation of the fifth embodiment, surround 18 is secured directly to front face of front board 38, for example, by glue or the like adhesive. FIG. 11B shows the same variation except in this variation each motor 20,22 is received inside a recess which extends only partially through the body of front board 38.

Figure 12:
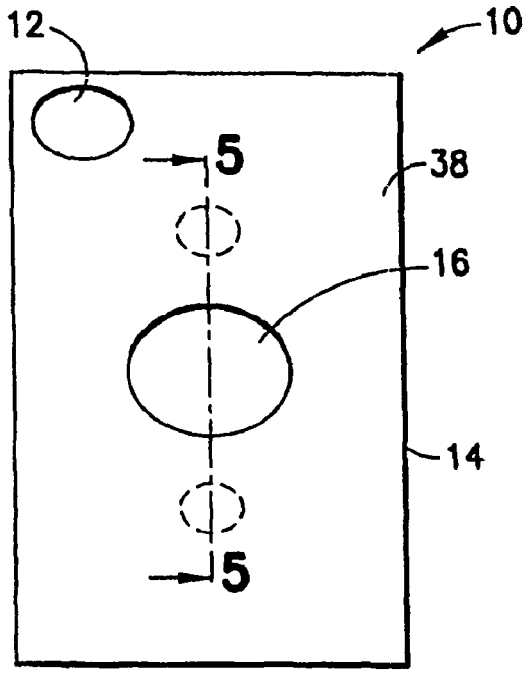
FIG. 12 illustrates a front plan view of a loudspeaker that includes a loudspeaker driver according to the present invention.
Figure 13:
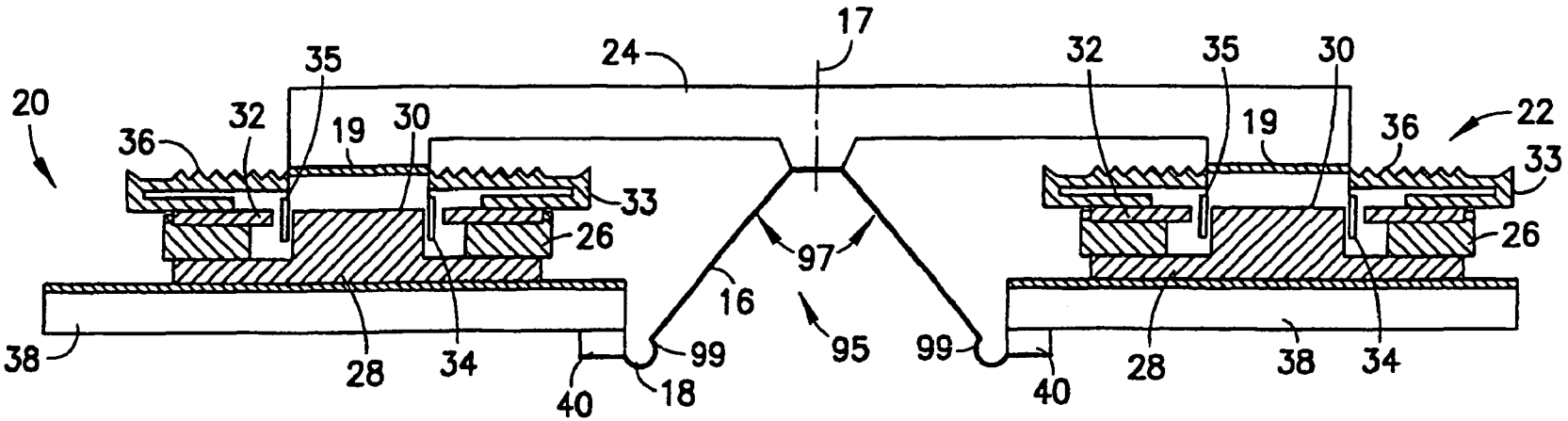
FIG. 13 illustrates a cross-sectional view of a loudspeaker driver according to an embodiment of the present invention as would be seen along line 5-5 viewed in the direction of the arrows.
Figure 14:
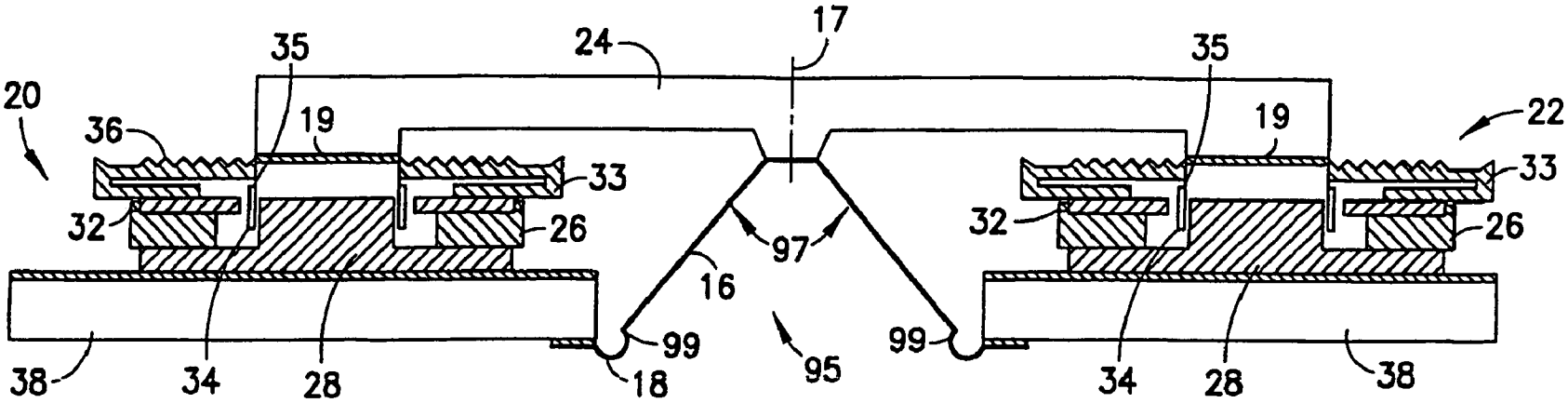
FIG. 14 illustrates a cross-sectional view of a loudspeaker driver according to an embodiment of the present invention as would be seen along line 5-5 viewed in the direction of the arrows.

Referring now to FIGS. 12 and 13, in which like numerals identify like features, in a loudspeaker driver according to the sixth embodiment of the present invention each motor 20, 22 is disposed on and secured to the back surface (the surface facing the interior of the cabinet) of front board 38. Glue or the like adhesive may be used to secure each motor in the manner described. FIG. 13 illustrates a variation in which a frame 40 (similar to frame 40 in the previous embodiment) is used to secure surround 18 to the front surface of front board 38. Referring to FIG. 14, in which like numerals identify like features, in another variation of the sixth embodiment surround 18 is secured to front board 38 directly with an adhesive such as glue or the like without an intervening frame 40.

Figure 15:
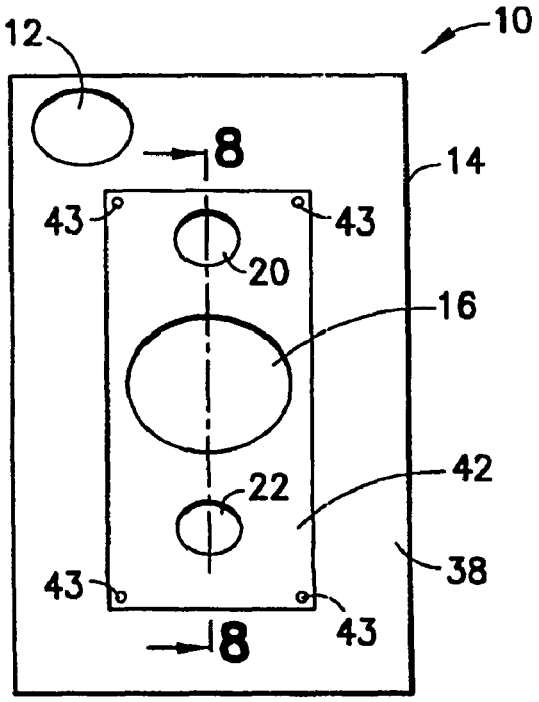
FIG. 15 illustrates a front plan view of a loudspeaker that includes a loudspeaker driver according to the present invention.
Figure 16:
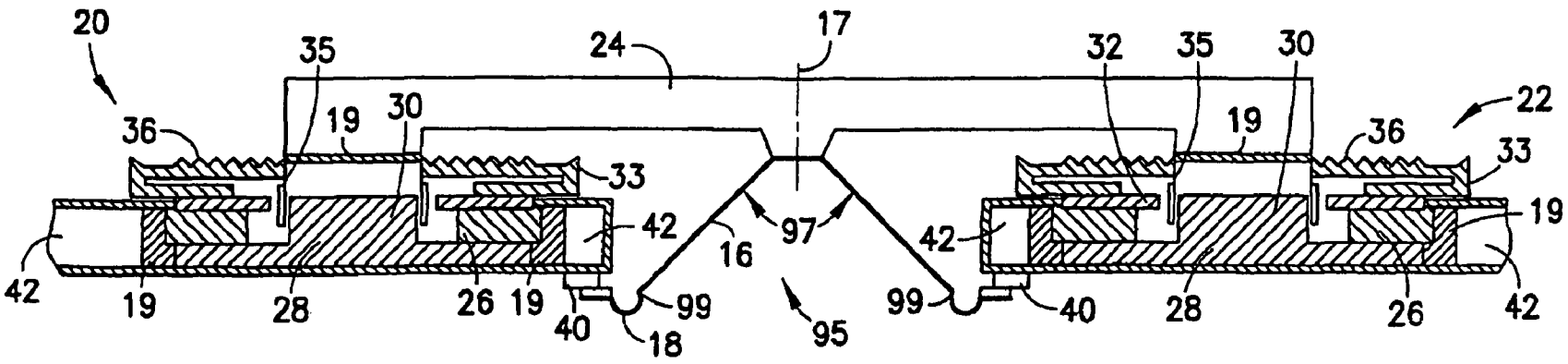
FIG. 16 illustrates a cross-sectional view of a loudspeaker driver according to an embodiment of the present invention as would be seen along line 8-8 viewed in the direction of the arrows.
Figure 17A:
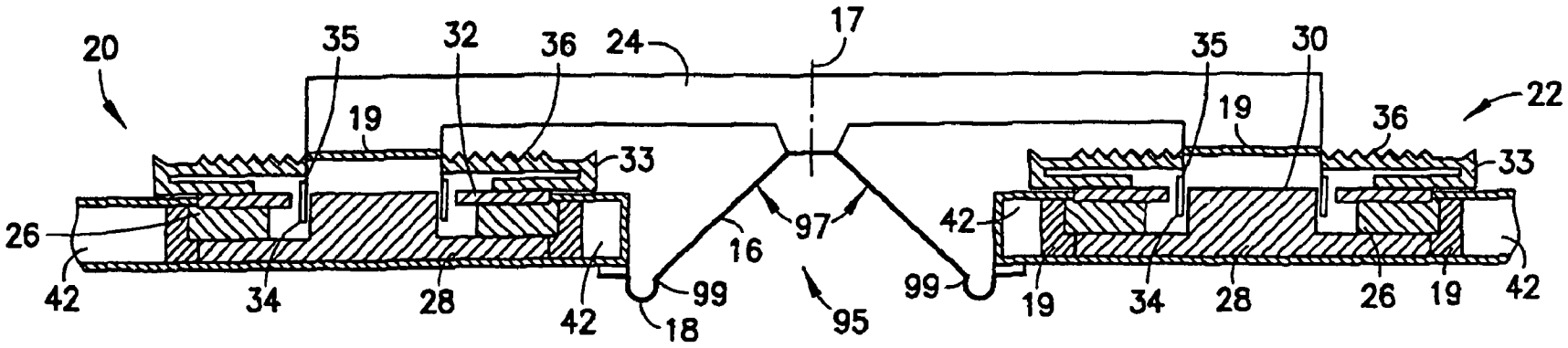
FIG. 17A illustrates a cross-sectional view of a loudspeaker driver according to an embodiment of the present invention as would be seen along line 8-8 viewed in the direction of the arrows.

Referring now to FIGS. 15 and 16, a loudspeaker driver according to the seventh embodiment includes a support frame 42 (serving as a support body instead of the front board of the cabinet). Support frame 42 may be stamped out of a sheet of metal of an appropriate thickness and includes openings for receiving motors 20,22. Thus, unlike the fifth and the sixth embodiments, a loudspeaker driver according to the seventh embodiment is not assembled on front board 38 of the cabinet. Rather, it is assembled onto support frame 42 (using an adhesive such as glue, or if appropriate through welding or brazing). Support frame 42 is then secured mechanically to front board 38 using, for example, screws 43 or the like mounting hardware. Note that in the variation shown by FIG. 16 surround 18 is secured to support frame 42 using a frame 40 (similar to frame 40 described above). Note that front board 38 is opened to receive the driver arrangement inside cabinet 12, thereby allowing the free motion of diaphragm 16. Referring now to FIG. 17A, alternatively, surround 18 may be adhesively attached using glue or the like to support frame 42 directly.

Figure 17B:
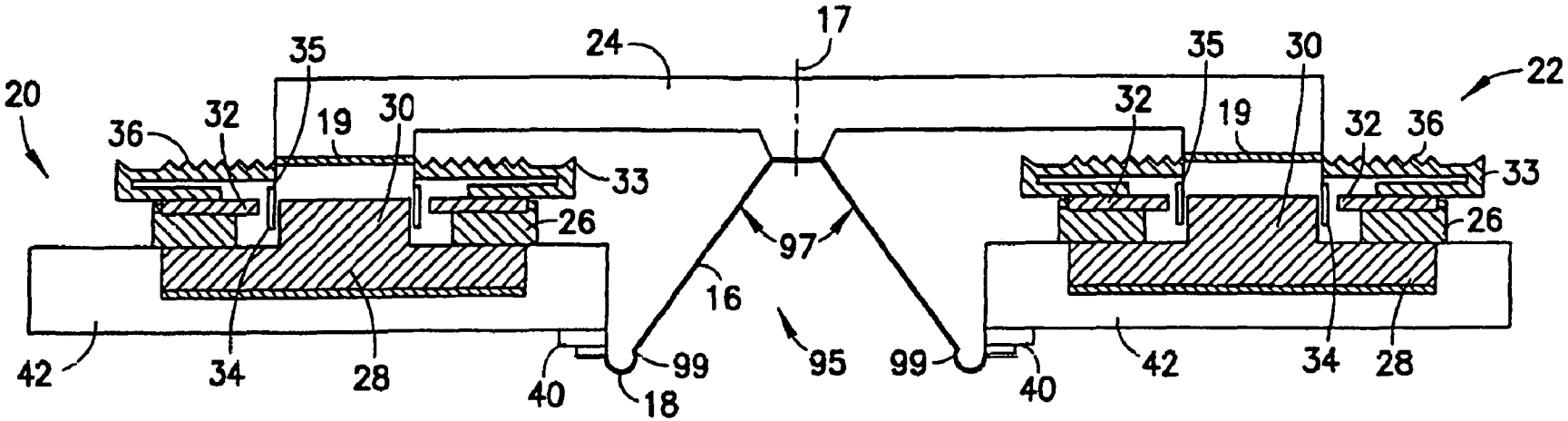
FIG. 17B illustrates a cross-sectional view of a loudspeaker driver according to an embodiment of the present invention as would be seen along line 8-8 viewed in the direction of the arrows.
Figure 17C:
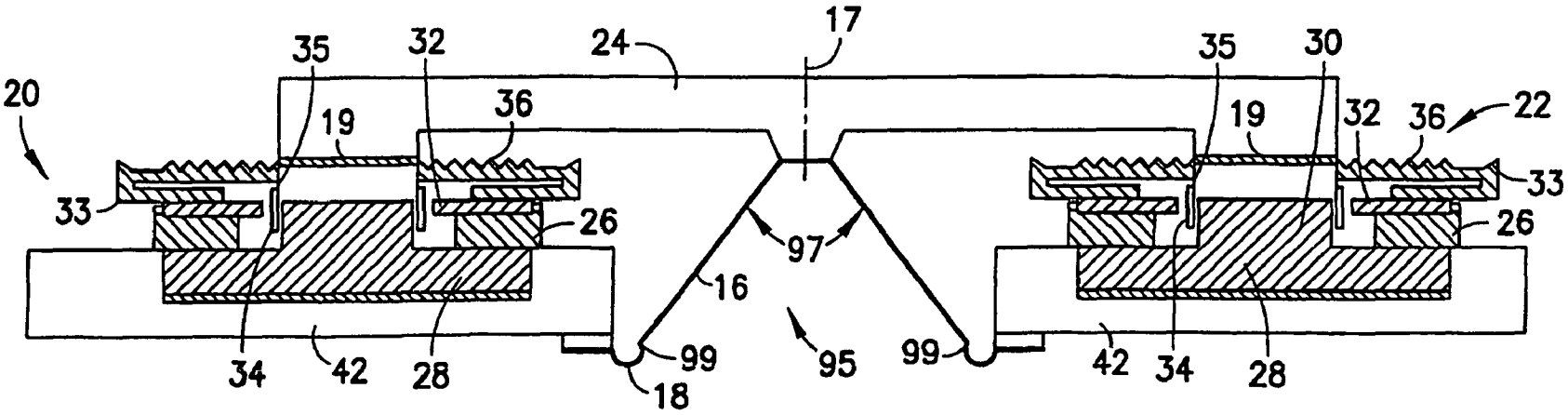
FIG. 17C illustrates a cross-sectional view of a loudspeaker driver according to an embodiment of the present invention as would be seen along line 8-8 viewed in the direction of the arrows.

Note that openings are not required in frame 42, rather a recess may be provided to receive each motor 20,22, without allowing the back surface of each motor to be exposed. FIGS. 17B and 17C illustrate such variations. FIG. 17B shows an example with frame 40 and FIG. 17C shows an example without frame 40 in which surround 18 is directly attached to frame 42 using glue or the like.

Figure 18:
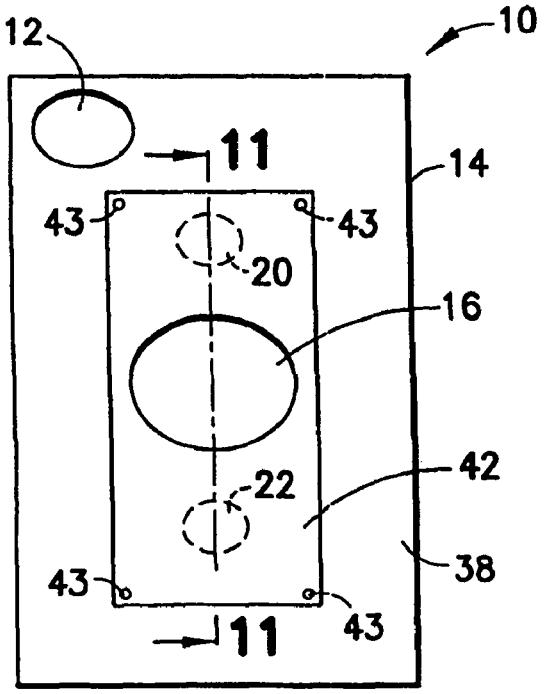
FIG. 18 illustrates a front plan view of a loudspeaker that includes a loudspeaker driver according to the present invention.
Figure 19:
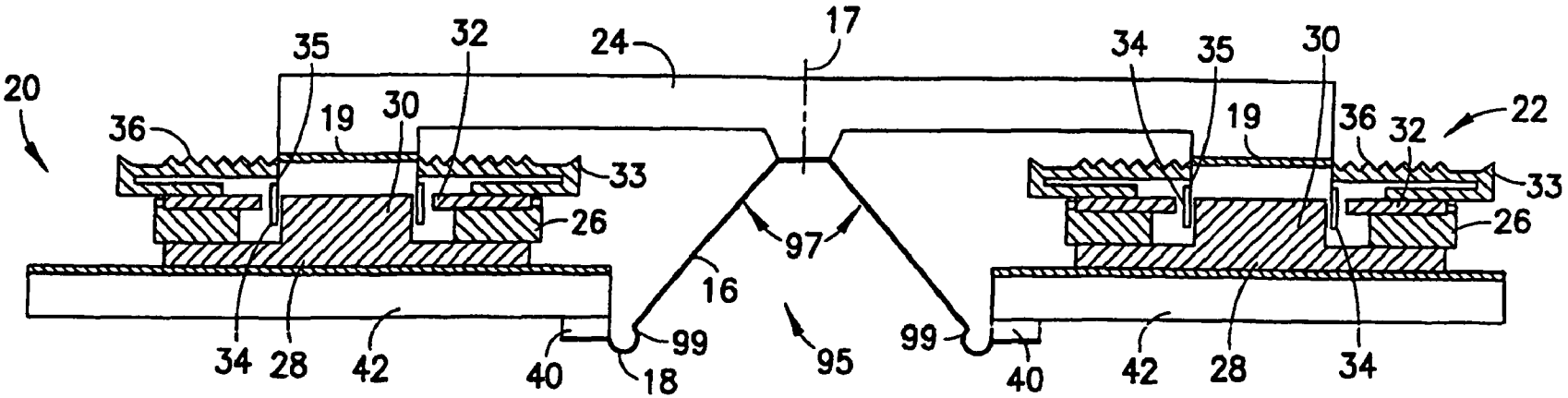
FIG. 19 illustrates a cross-sectional view of a loudspeaker driver according to an embodiment of the present invention as would be seen along line 11-11 viewed in the direction of the arrows.

Referring now to FIGS. 18 and 19, in which like numerals identify like features, a loudspeaker driver according to the eighth embodiment of the present invention includes motors 20,22 attached to a back surface of support frame 42. Thus, unlike the seventh embodiment, openings are not required to receive each motor 20,22.

Figure 20:
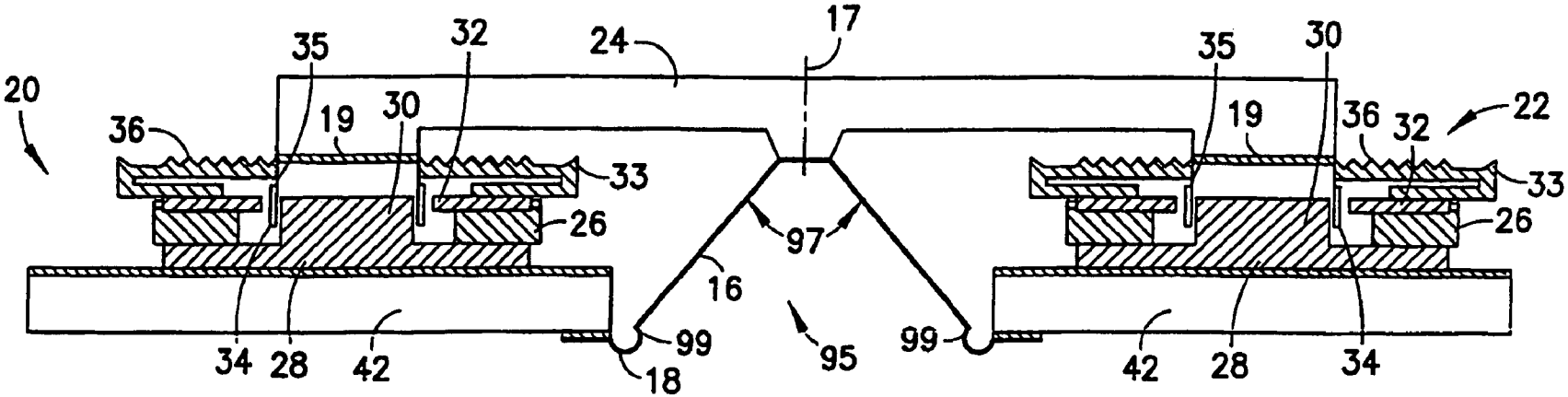
FIG. 20 illustrates a cross-sectional view of a loudspeaker driver according to an embodiment of the present invention as would be seen along line 8-8 viewed in the direction of the arrows.

Note that in the variation shown by FIG. 19, surround 18 is secured to support frame 42 using a frame 40 (similar to frame 40 described above). FIG. 20 shows another variation in which surround 18 is adhesively attached using glue or the like to support frame 42 directly.

Figure 21:
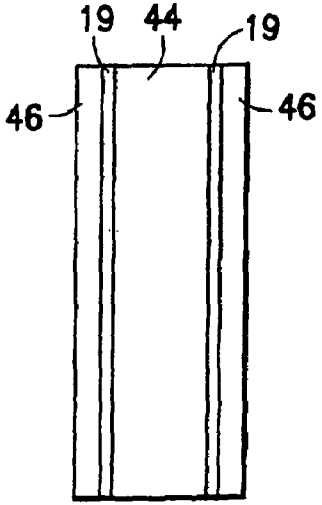
FIG. 21 is across-sectional view of transmission frame 24 along line 13-13 (FIG. 10A) viewed in the direction of the arrows.

Referring to FIG. 21, in the preferred embodiment of the present invention, transmission frame 24 includes a soft core 44, and a relatively rigid outer clad 46 on each side thereof and attached thereto with glue or the like adhesive 19. The soft core 44 may be made from foam board (e.g. foam board sold under the U.S. registered trademark FOME-COR) or the like material while outer clad 26 may be made from a sheet of aluminum or the like material. It has been found that such an arrangement provides high rigidity and is light enough to serve as an appropriate transmission frame 24 particularly when transmission frame 24 is coupled to diaphragm 16 such that axis 17 is parallel to the plane that run parallel to soft core 44, and clads 46. It has also been found that such an arrangement does not exhibit excessive vibration that my color the reproduction of sound.

Figure 22B:
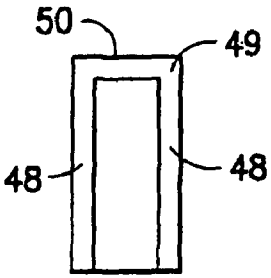
FIG. 22B shows a cross-sectional view of the transmission frame of FIG. 22A along line 14B-14B viewed in the direction of the arrows.
Figure 22A:
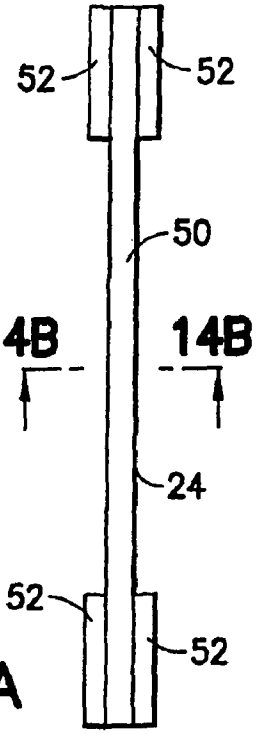
FIG. 22A illustrates a top plan view of another transmission frame.

Referring to FIGS. 22A and 22B, a transmission frame 24 according to an alternative design may include a metallic sheet, e.g. aluminum sheet 49, bent (see FIG. 22B) through stamping or the like to have two parallel walls 48 linked through a central spine portion 50. The space between parallel walls 48 may or may not be filled with a soft core such as foam board or the like material. Note that transmission frame 24 according to the variation shown by FIG. 22A includes feet portions 52 at each end thereof. Each feet 52 may provide additional surface area for attachment to a respective former of a voice coil.

Figure 23A:
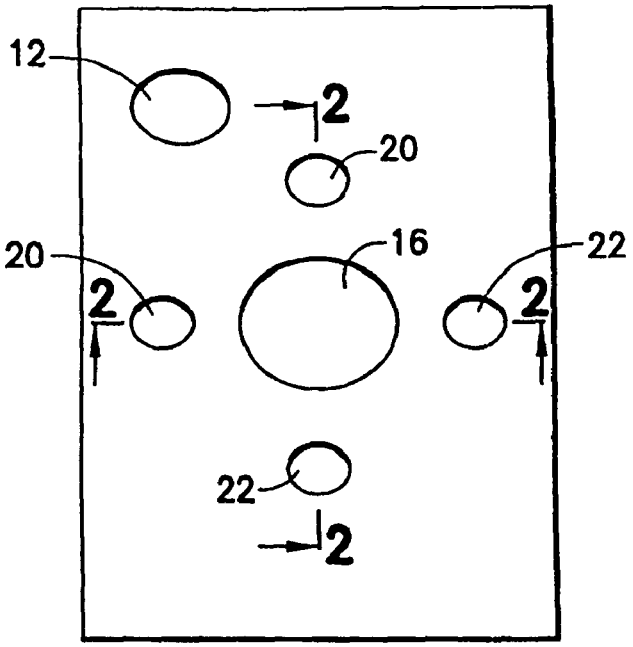
FIG. 23A shows a front plan view of a speaker that includes a loudspeaker driver according to the present invention.
Figure 23B:
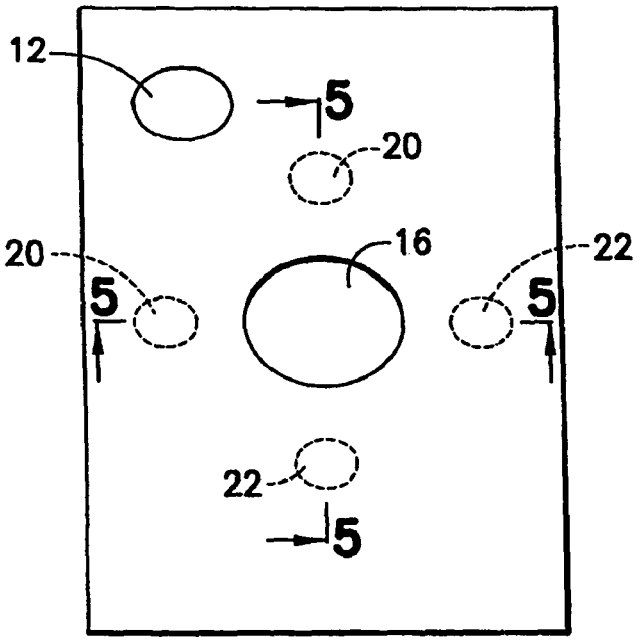
FIG. 23B shows a front plan view of a speaker that includes a loudspeaker driver according to the present invention.

Referring to FIGS. 23A and 23B, it should be noted that a loudspeaker driver according to the present invention may include more than two motors. For example, a loudspeaker driver according to the present invention may include a driver with four motors coupled to a diaphragm through a transmission frame as described above without deviating from the present invention.

Figure 24A:
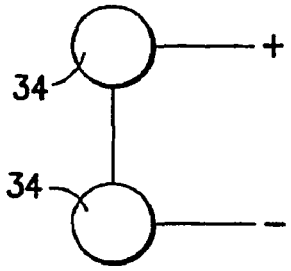
FIGS. 24A-24E illustrate various wiring configurations for the coils of a multi-motor loudspeaker driver according to the present invention.
Figure 24B:
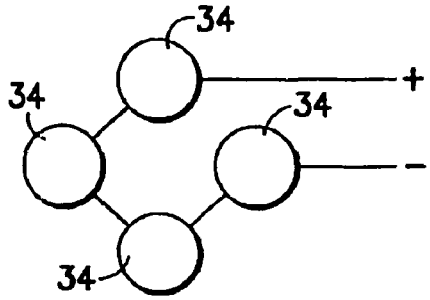
Figure 24C:
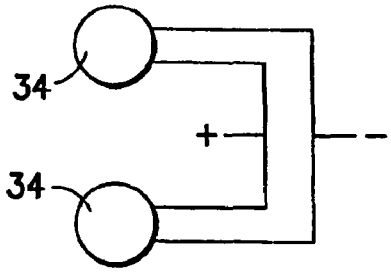
Figure 24E:
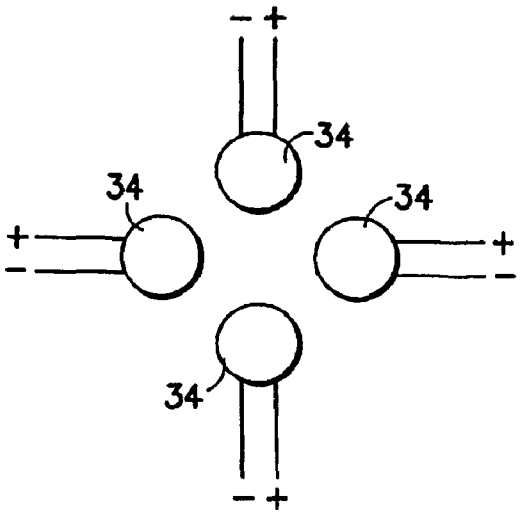
Figure 24D:
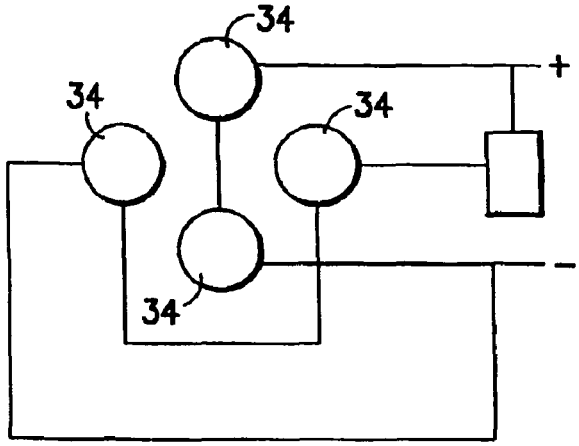

The coils in each motor in a multi-motor driver according to the present invention may be series connected as illustrated by FIG. 24A (a loudspeaker driver with two motors) and FIG. 24B (four motors), parallel connected (FIG. 24C), a combination of two series connected two motor circuits parallel connected (FIG. 24D), or each motor can be individually connected to a signal source without being connected to another motor (FIG. 24E).

One advantage of a driver arrangement according to the present invention is that the same mechanical power can be transmitted to the diaphragm using two or more smaller motors as a single large motor. Given that large magnets are expensive, the cost of the loudspeaker driver may be reduced without sacrificing performance.

Another advantage of the present invention is that the depth of the loudspeaker driver can be reduced thus allowing the depth of the cabinet to be reduced. As a result low profile (thickness) speaker cabinets can be used with a loudspeaker driver according to the present invention.

Moreover, a driver arrangement according to the present invention allows for widening the diaphragm without increasing the depth of the driver. Thus, a driver having a large area diaphragm can have the same depth as a smaller area diaphragm.

Figure 25:
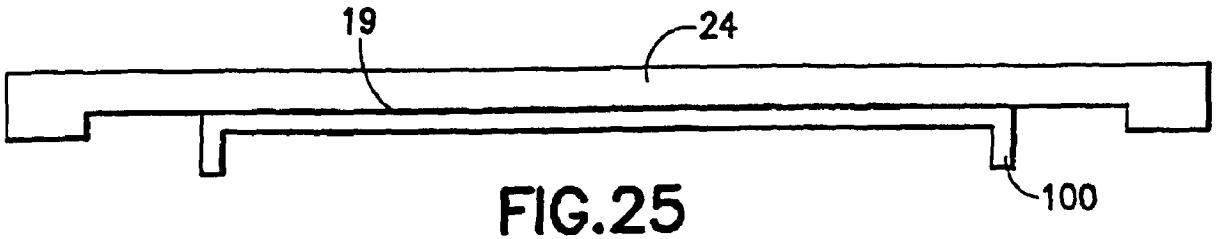
FIG. 25 illustrates a cylindrical diaphragm in combination with a transmission frame according to another embodiment of the present invention.

FIG. 25 illustrates a cylindrical diaphragm 100 in combination with a transmission frame 24 according to the present invention which can replace the combination of a cone-shaped diaphragm and a transmission frame 24 in each embodiment disclosed herein. The replacement of a cone-shaped diaphragm with a cylindrical diaphragm 100 allows for more volume of air to be moved without changing the diameter given an equal height. Furthermore, it may allow for the same volume of air that is moved by a cone of a certain diameter with a shallower depth. Thus, the height of the diaphragm and transmission frame combination may be reduced, thereby allowing for further reduction of the depth of the loudspeaker driver. Note also that frame 24 may be connected with adhesive 19 or the like to a larger area at the back surface of the cylindrical diaphragm 100 which may result in a more secure coupling and better transmission of the mechanical force from motors 20, 22 to cylindrical diaphragm 100.

Note further that according to the present invention, in each embodiment disclosed herein, the voice coil of each driver that is suspended in a magnetic field is disposed lateral to and outside the open mouth of the diaphragm. The open mouth of the diaphragm in each embodiment is defined by a terminal boundary 99 residing at the outermost lateral edge of the diaphragm (which in some embodiments shown herein is coupled to the surround/suspension) surrounding the entire interior surface area 97 of the diaphragm. Thus, each voice coil in each embodiment disclosed herein is disposed lateral to and outside of the interior region 95 defined by the outermost edge of the diaphragm.

According to another aspect of the present invention, rather than having two motors lateral to the outer to and outside the open mouth of the diaphragm one or more motors are disposed between two motors and connected to the back of the two diaphragms using a transmission frame as disclosed above.

Referring, for example, to FIGS. 26-34, in which like numerals identify like features disclosed herein, a motor 20 is disposed lateral to the outer edge of at least two diaphragms 16 on a support body 42. Motor 20 may be secured to support body 42 using an adhesive or the like. A transmission frame 24 is then coupled to former 35 of motor 20 using an adhesive 19' or the like and coupled at each terminal free end thereof to a back surface of a respective diaphragm 16 using an adhesive or the like as specifically illustrated by FIG. 34. As disclosed earlier, the motion of former 35 along the central axis thereof causes the motion of transmission 24 along the same axis which in turn causes the motion of diaphragms 16 along the central axis 17 thereof.

Figure 26:
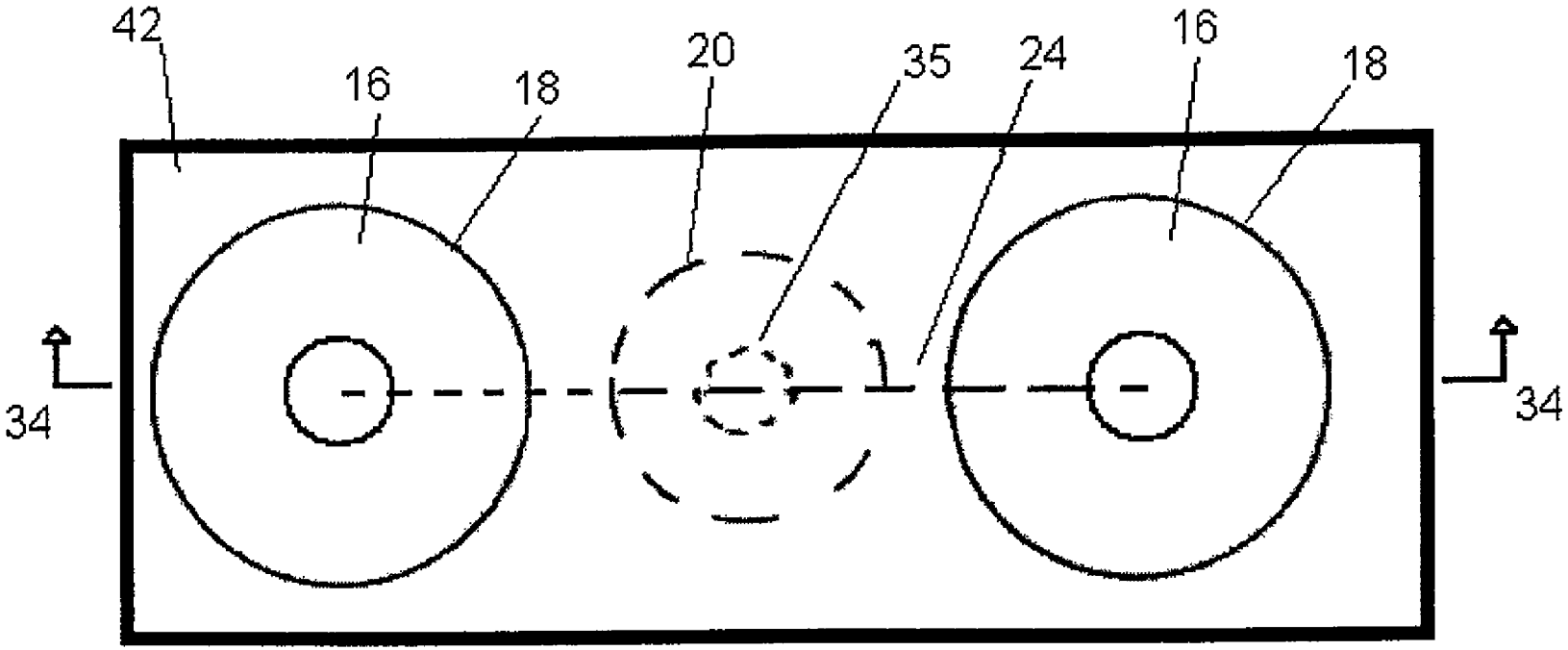
FIG. 26 illustrates a front plan view of a loudspeaker driver according to another embodiment of the present invention.
Figure 27:
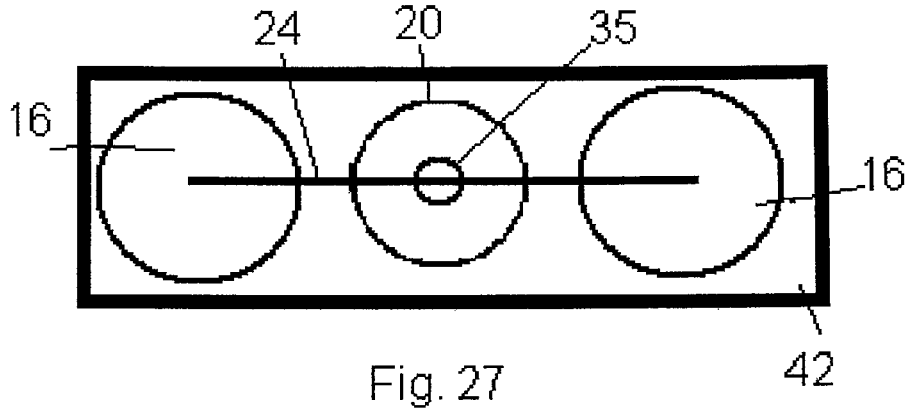
FIG. 27 illustrates a back plan view of a loudspeaker driver according to FIG. 26.
Figure 28:
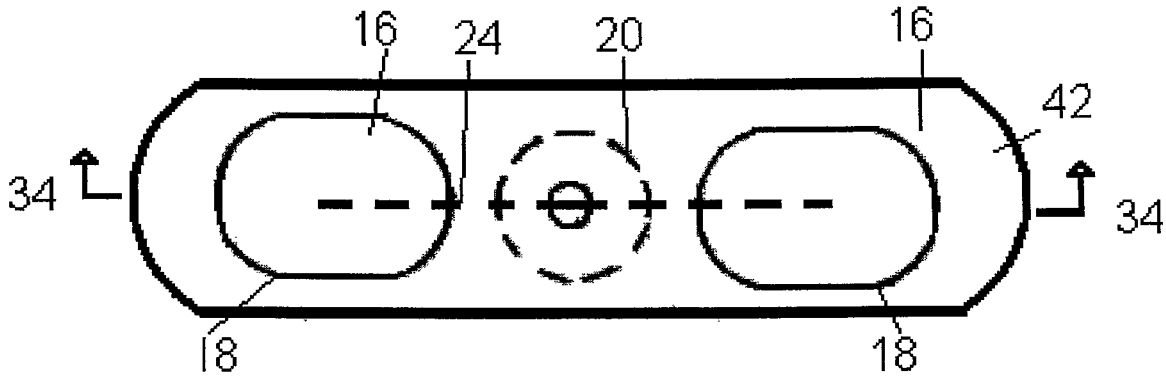
FIG. 28 illustrates a front plan view of a loudspeaker driver according to another embodiment of the present invention.
Figure 29:
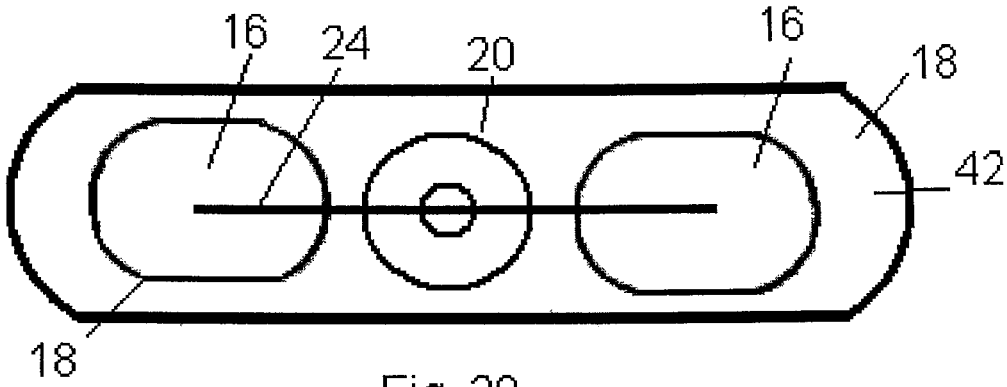
FIG. 29 illustrates a back plan view of a loudspeaker driver according to FIG. 28.

In the embodiment illustrated by FIGS. 26 and 27 conically shaped diaphragms are used while in the embodiment illustrates by FIGS. 28 and 29 oval or race track shaped diaphragms 16 are used. Furthermore, in the embodiments disclosed by FIGS. 26-29 two diaphragms 16 and an elongated bar shaped transmission frame 24 are used.

Figure 30:
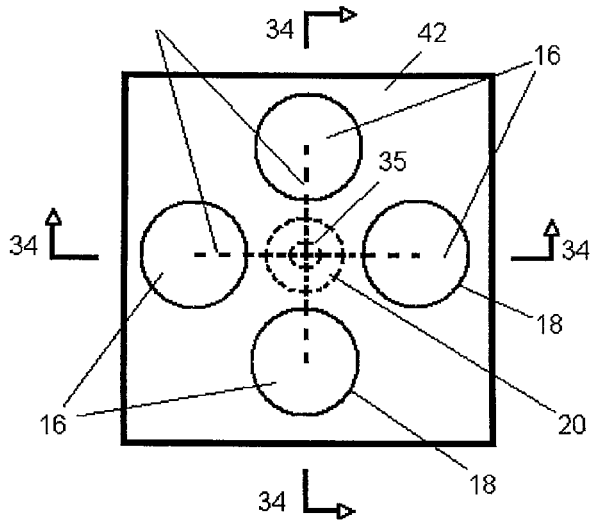
FIG. 30 illustrates a front plan view of a loudspeaker driver according to another embodiment of the present invention.
Figure 31:
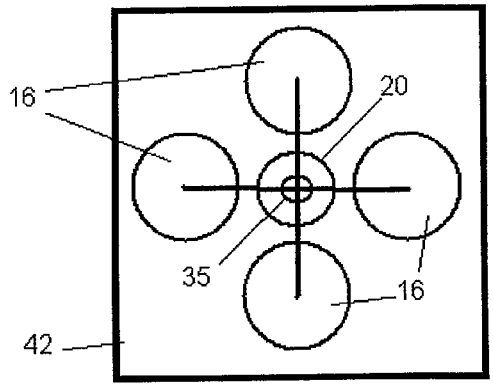
FIG. 31 illustrates a back plan view of a loudspeaker driver according to FIG. 30.

Referring now to FIGS. 30 and 31, in which like numerals identify like features, four diaphragms are used instead of two. Furthermore, former 35 is coupled to respective back surfaces of diaphragms 16 using a cross-shaped transmission which is coupled using an adhesive or the like at the central portion thereof to former 35 and coupled at terminal free ends thereof to respective back surfaces of diaphragms 16.

Figure 32:
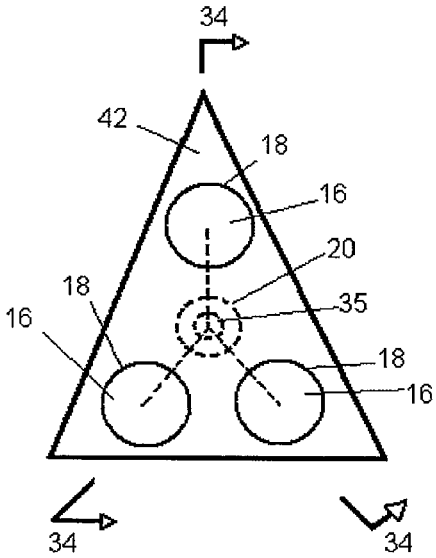
FIG. 32 illustrates a front plan view of a loudspeaker driver according to another embodiment of the present invention.
Figure 33:
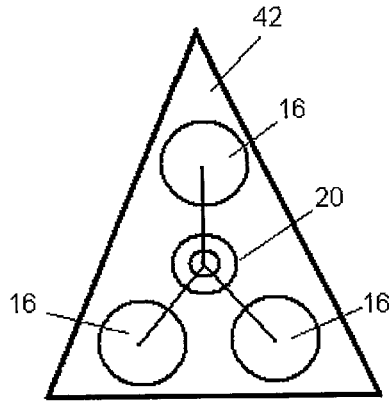
FIG. 33 illustrates a back plan view of a loudspeaker driver according to FIG. 32.
Figure 34:
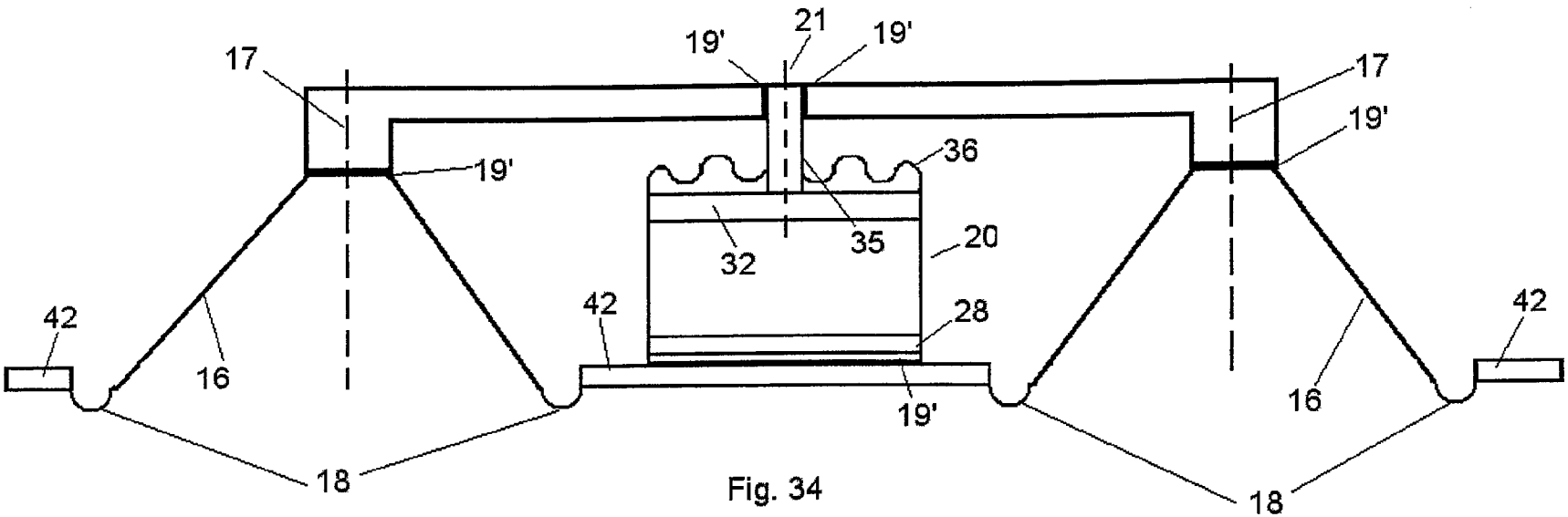
FIG. 34 is a cross-sectional view along line 34 in each one of the embodiments illustrated in FIGS. 26-33 viewed in the direction of the arrows.

Referring now to FIGS. 32 and 33, in yet another embodiment, three diaphragms 16 are arranged around motor 20 each preferably at an equal angular spacing from the other two diaphragms. A three-legged transmission 24 is coupled using adhesive or the like at the center thereof to former 35 of motor 20, while each free terminal end of each leg of transmission 24 is coupled to the back of a respective diaphragm.

Referring now to FIGS. 35-38, and 46-47, in which like numerals identify like features, according to another aspect of the present invention two motors 20, 22 are disposed on a support frame 42 between at least two diaphragms 16. Motors 20 and 22 can be secured to support frame 42 using an adhesive 19' or the like. A cross-shaped transmission 24 can couple the two motors to the back surface of diaphragms 16. Specifically, cross-shaped transmission 24 includes two bar portions 24' crossing one another. Each bar portion 24' includes a terminal free end. Terminal free ends of one bar portion 24' are coupled using adhesive 19' or the like to former 35 of motors 20 and 22 respectively (see FIG. 47), while terminal free ends of the other bar portion 24' is coupled to respective back surfaces of diaphragms 16 (see FIG. 46) using adhesive 19' or the like.

Figure 37:
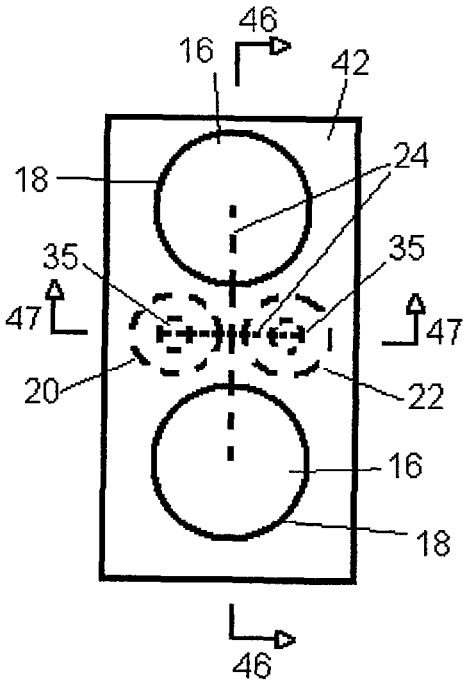
FIG. 37 illustrates a front plan view of a loudspeaker driver according to another embodiment of the present invention.
Figure 38:
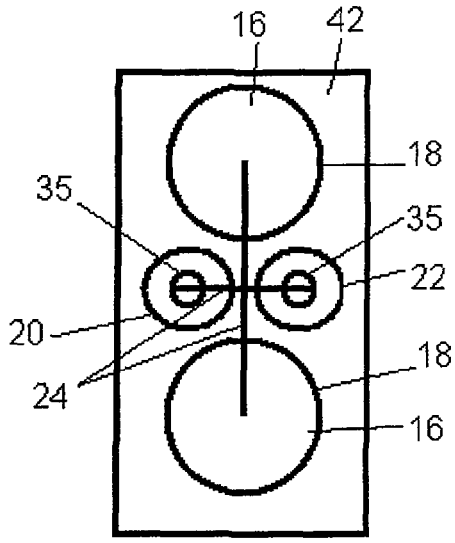
FIG. 38 illustrates a back plan view of a loudspeaker driver according to FIG. 37.
Figure 35:
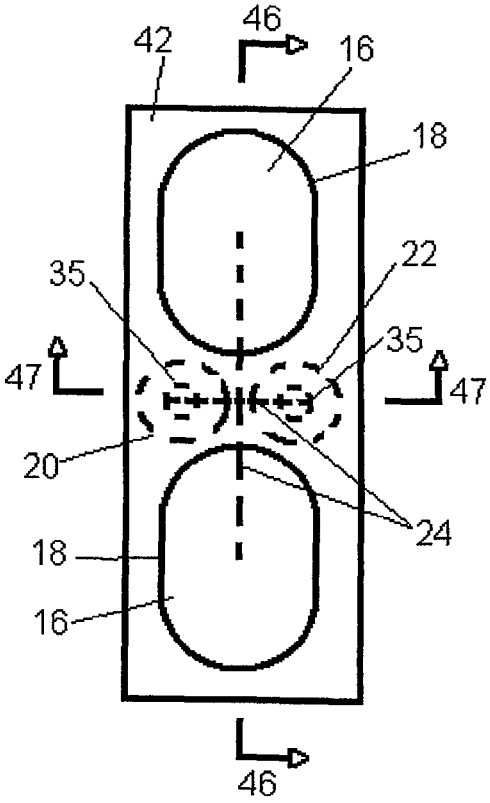
FIG. 35 illustrates a front plan view of a loudspeaker driver according to another embodiment of the present invention.
Figure 36:
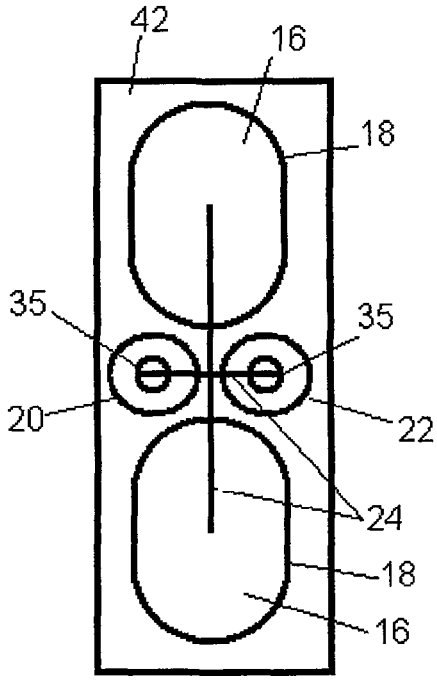
FIG. 36 illustrates a back plan view of a loudspeaker driver according to FIG. 35.

Note that in the embodiment illustrated by FIGS. 35 and 36 diaphragms 16 are oval or racetrack shaped while in the embodiment illustrated by FIGS. 37 and 38 diaphragms 16 are conical. Note further than motors 20,22 can be connected electrically in series, in parallel, or each may be connected to a different signal source.

Figure 40:
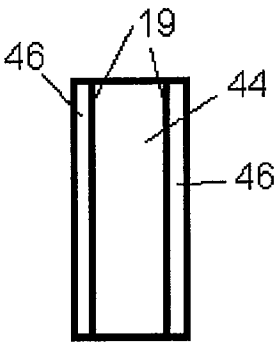
FIG. 40 shows a cross-sectional view along line 40-40 in FIG. 39 viewed in the direction of the arrows.
Figure 41:
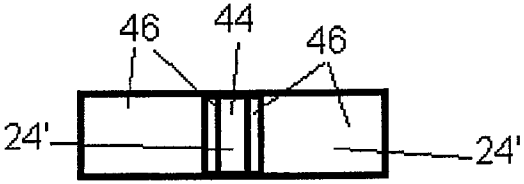
FIG. 41 shows a cross-sectional view along line 41-41 in FIG. 39 viewed in the direction of the arrows.
Figure 39:
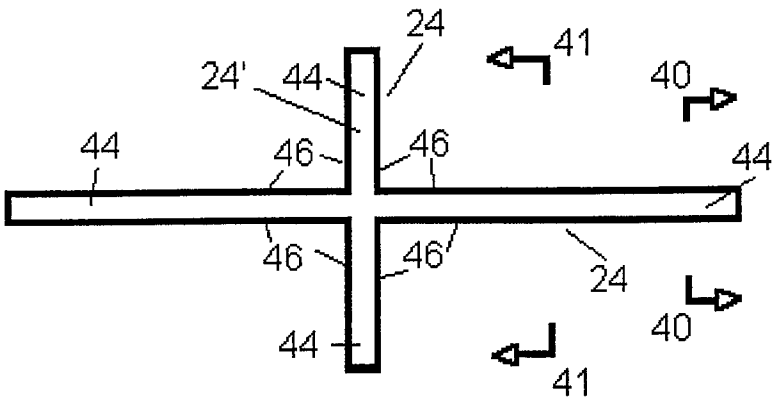
FIG. 39 shows a top plan view of a cross-shaped transmission as used in some embodiments of the present invention.

Referring now to FIGS. 39 to 41, a cross-shaped transmission 24, which may include two bar-shaped portions 24', is preferably constructed by adhering two metallic webs 46 (example aluminum webs 46) to the opposing outside surfaces of a core 44 using preferably an adhesive. Note that core 44 may be comprised of foam core, cardboard, or styrofoam. Other constructions such as the construction disclosed above can also be used without deviating from the present invention.

Figure 43:
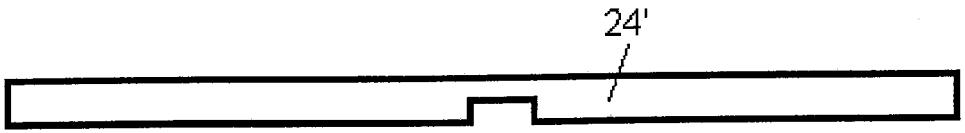
FIGS. 42 and 43 illustrate side plan views of transmission portions of a cross-shaped transmission according to one arrangement.
Figure 42:
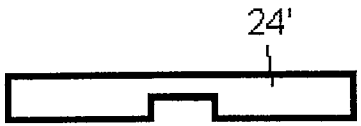

Referring now to FIGS. 42 and 43, to construct a transmission 24 using two separate portions 24' a recess or notch 24" is provided in each portion 24'. Each recess or notch 24" is aligned with the other and an adhesive or the like may be then used to secure portions 24" to one another to obtain a cross-shaped transmission 24.

Figure 45:
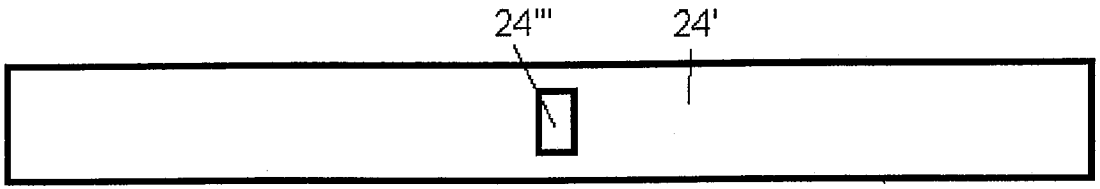
FIGS. 44 and 45 illustrate side plan views of transmission portions of a cross-shaped transmission according to another arrangement.
Figure 44:
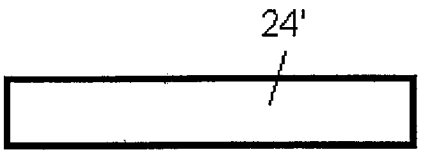
Figure 46:
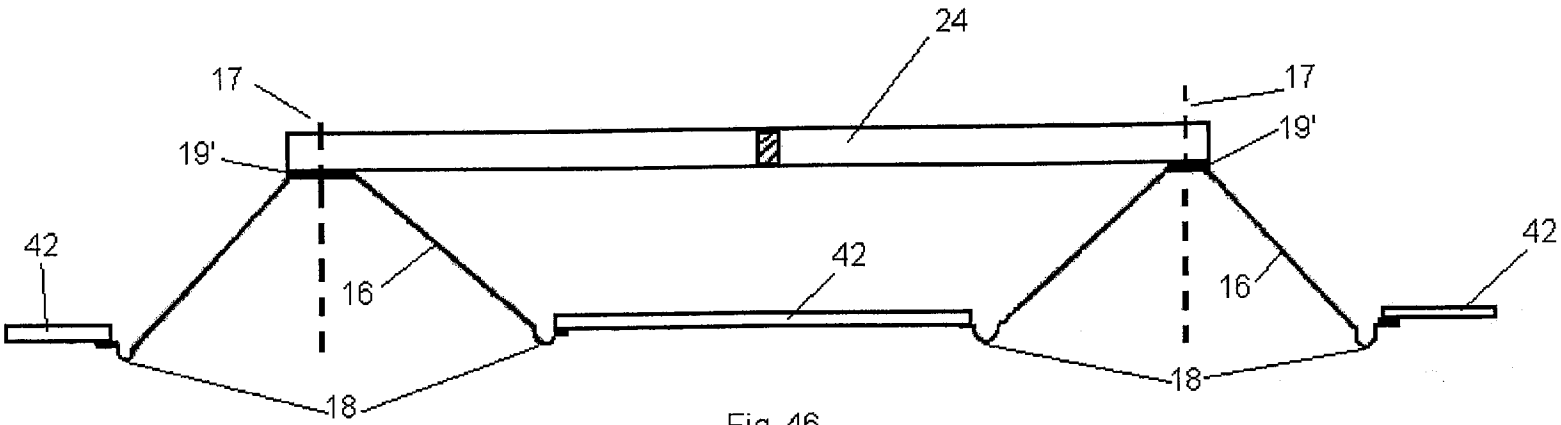
FIG. 46 shows a cross-sectional view along line 46-46 in FIGS. 35 and 37 viewed in the direction of the arrows.
Figure 47:
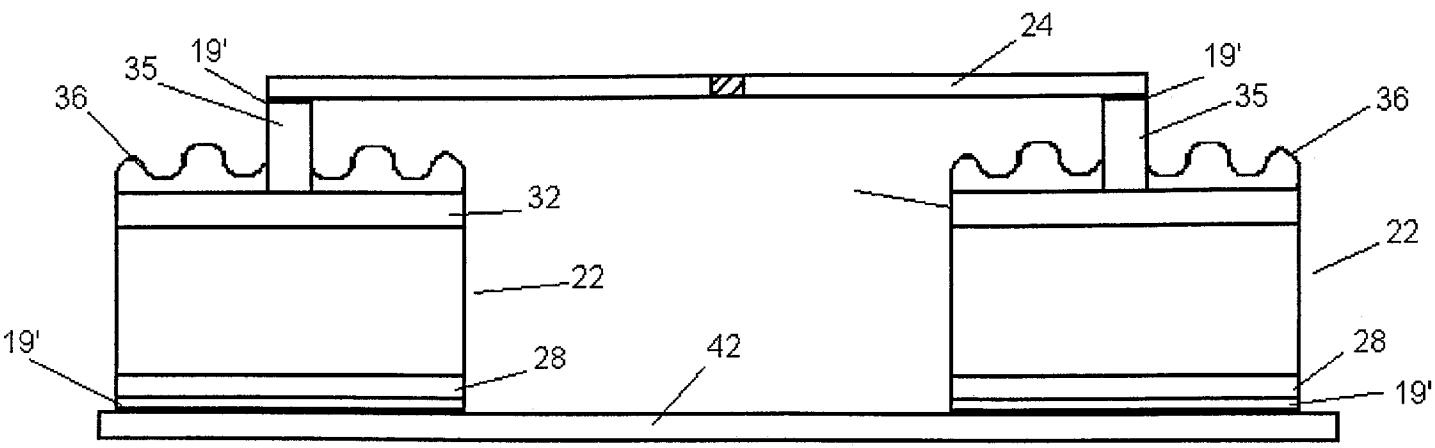
FIG. 47 shows a cross-sectional view along line 47-47 in FIGS. 35 and 37 viewed in the direction of the arrows.

Referring to FIGS. 44 and 45, alternatively, one of the portions 24" (preferably the longer of the two portions 24") can be provided with an opening 24'" to receive the other of the two portions 24" to obtain a cross-shaped transmission 24. Adhesive or the like may be then used to further secure the two portions to one another.

Alternatively, a single cross-shaped transmission shape may be punched out of a sheet of aluminum metal.

It should be noted that in each of the embodiments depicted by FIGS. 26-27, the loudspeaker driver includes a plurality of diaphragms that are spaced laterally from one another, and a driving section (that includes at least one motor) that drives the diaphragms is disposed only in the space between the diaphragms. That is, a driving section is located in a position lateral to and between the open mouths of the diaphragms.

Note that a motor 20 or motors 20,22 may be partially or fully received or embedded in the support 42. That is, for example, support 42 may be provided with a recess (partial embedding) or a through opening (full embedding which allows the back of the motor to be exposed through support 42) in which a motor may be received.

Referring now to FIGS. 48A-48B, and 48C-48E, a loudspeaker driver according to another embodiment of the present invention includes a pan-shaped support 360, which may be formed with stamped metal or the like. Support 360 includes a circular opening 460 therein at the bottom thereof. The opening is large enough to receive a diaphragm/cone 340 (e.g. paper cone or the like) having a surround 380 (e.g. foam or rubber surround) attached to the edge of the base thereof (i.e. the large mouth of cone 340). The outer edge of surround 380 is then attached to the edge of opening 460 (identified as flange 440), whereby cone 340 is attached to support 360 for movement along the central axis thereof much like a conventional cone-based loudspeaker driver. At least two motors 100 are attached using a proper adhesive, for example, to the bottom interior surface of pan-shaped support 360 opposite one another and at the edge of opening 460. Note that preferably motors 100 extend partially over opening 460 to be as close as possible to one another without interfering with the motion of cone 340. A transmission 420 is coupled to a back surface (surface facing away from interior of support 360) of cone 340 as close to the central axis of cone 340. Each end of transmission 420 is coupled to a respective former 220 of a motor 100, whereby the motion of formers 220 along the central axis thereof will cause the corresponding motion of cone 340 along its central axis. Examples of proper transmissions are disclosed above. Support 360 includes a plurality of mounting holes disposes along the bottom surface thereof for mounting a driver according to the present invention on a front board of a speaker cabinet or the like such that the interior of cone 340 faces the outside of the cabinet. Note that a seal or the like may be disposed inside support 360 along the edges thereof to prevent or at least hinder the free transmission of air into and out of the speaker cabinet.

Figures 48A, 48B, 48C:
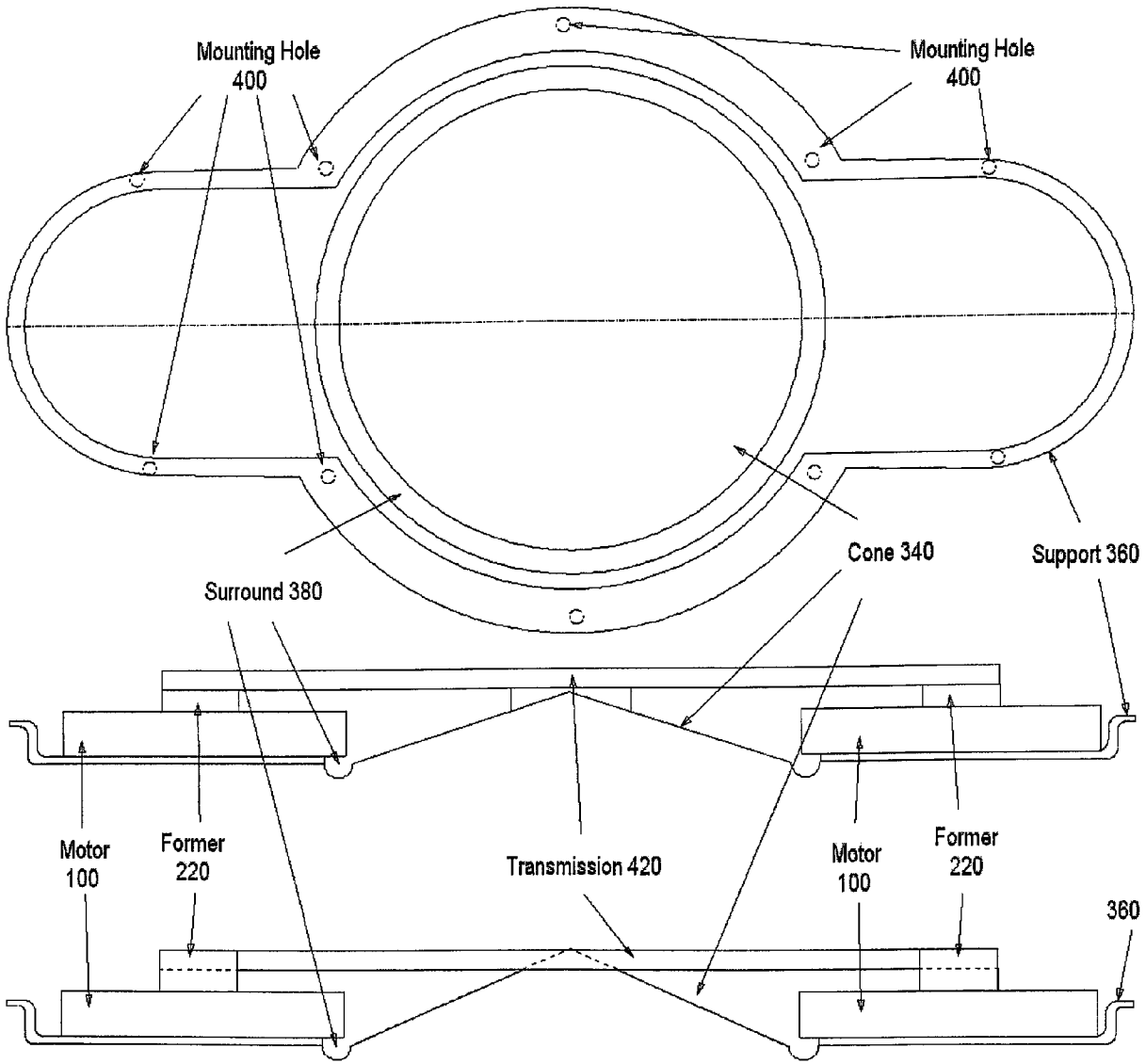
FIG. 48A shows a front plan view of a driver according to another embodiment of the present invention.
FIG. 48B shows a cross-sectional view of a driver according to one variation of the embodiment shown by FIG. 48A along the broken line in FIG. 48A.
FIG. 48C shows a cross-sectional view of a driver according to another variation of the embodiment shown by FIG. 48A along the broken line in FIG. 48A.
Figures 48D, 48E:
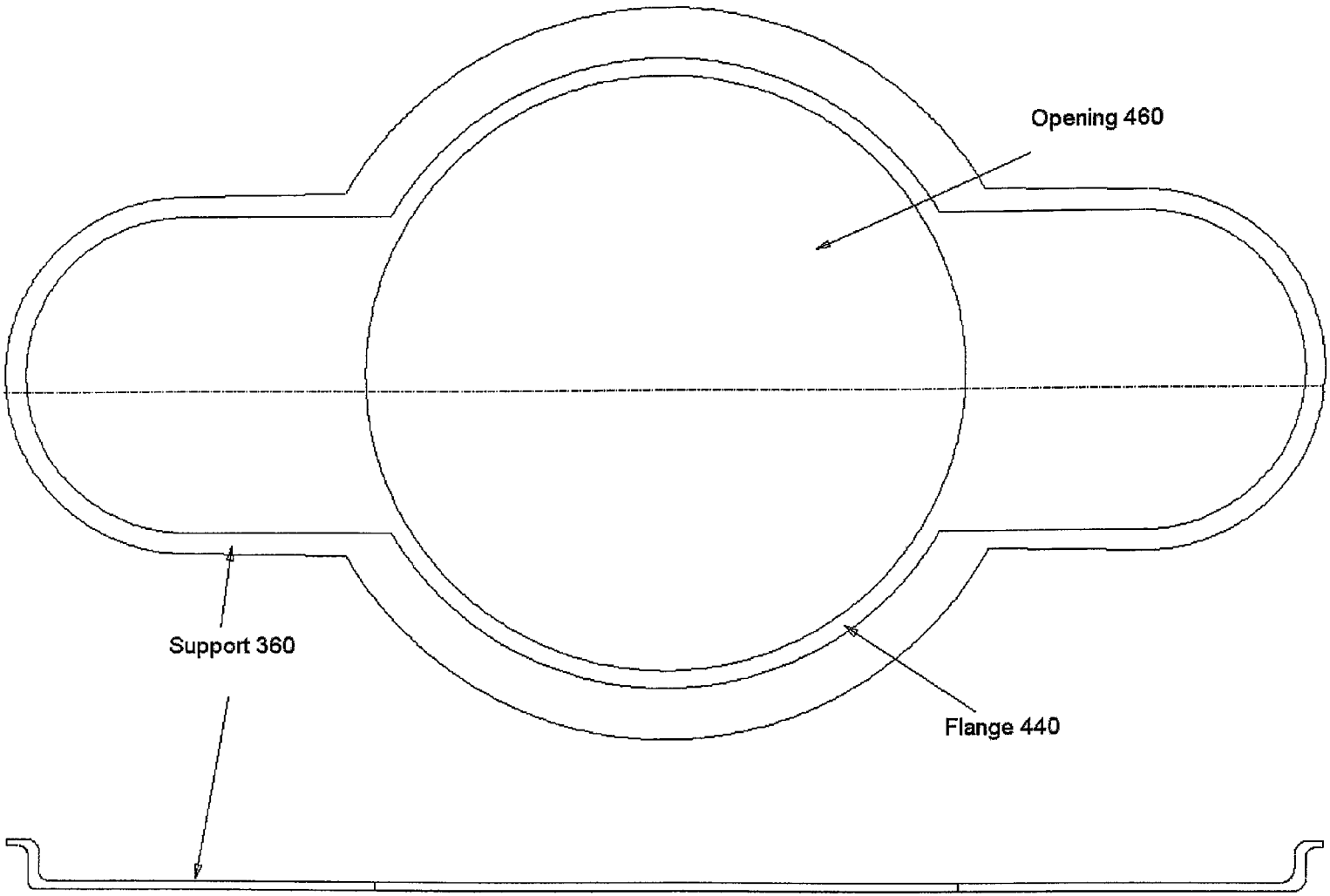
FIG. 48D shows a front plan view of a support for the embodiments shown by FIG. 48A-48C.
FIG. 48E shows a cross-sectional view of the support shown in FIG. 48D along the broken line shown therein.
Figure 49A:
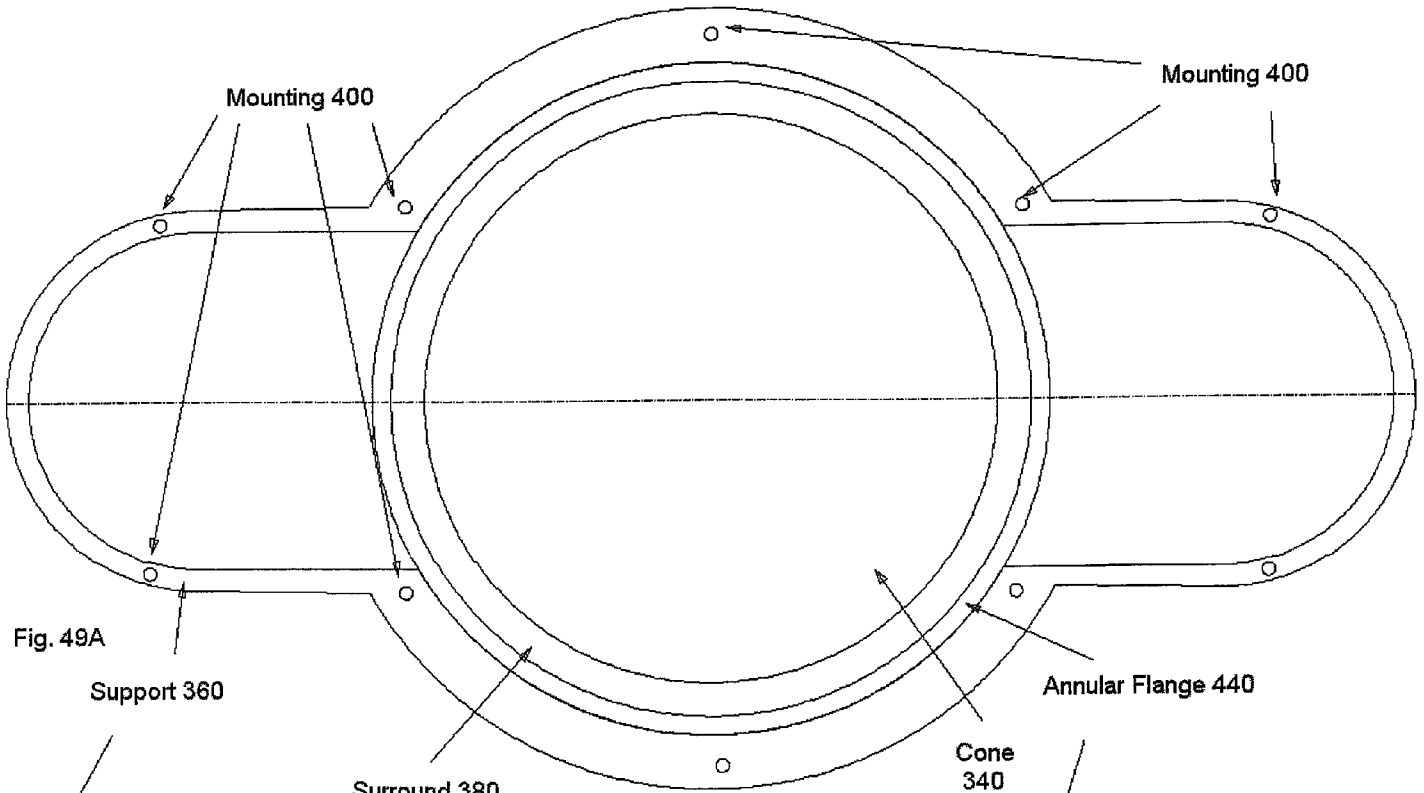
FIG. 49A shows a front plan view of a driver according to another embodiment of the present invention.
Figure 49B:
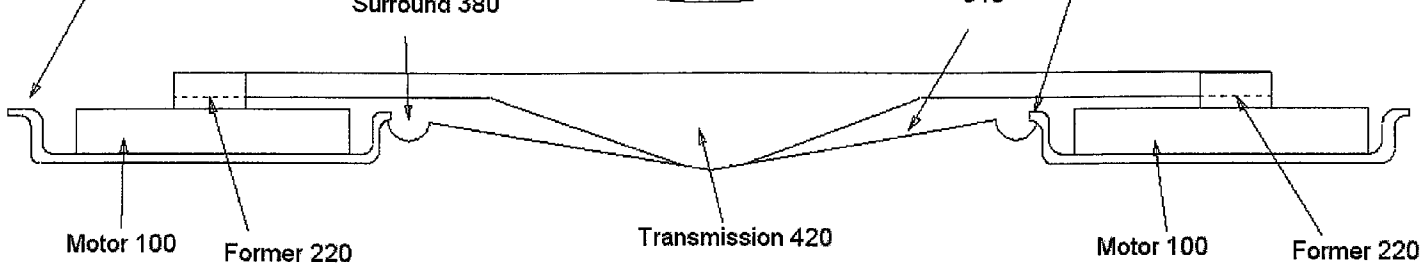
FIG. 49B shows a cross-sectional view of a driver according to a variation of the embodiment illustrated by FIG. 49A along the broken line in FIG. 49A.
Figures 49C, 49D:
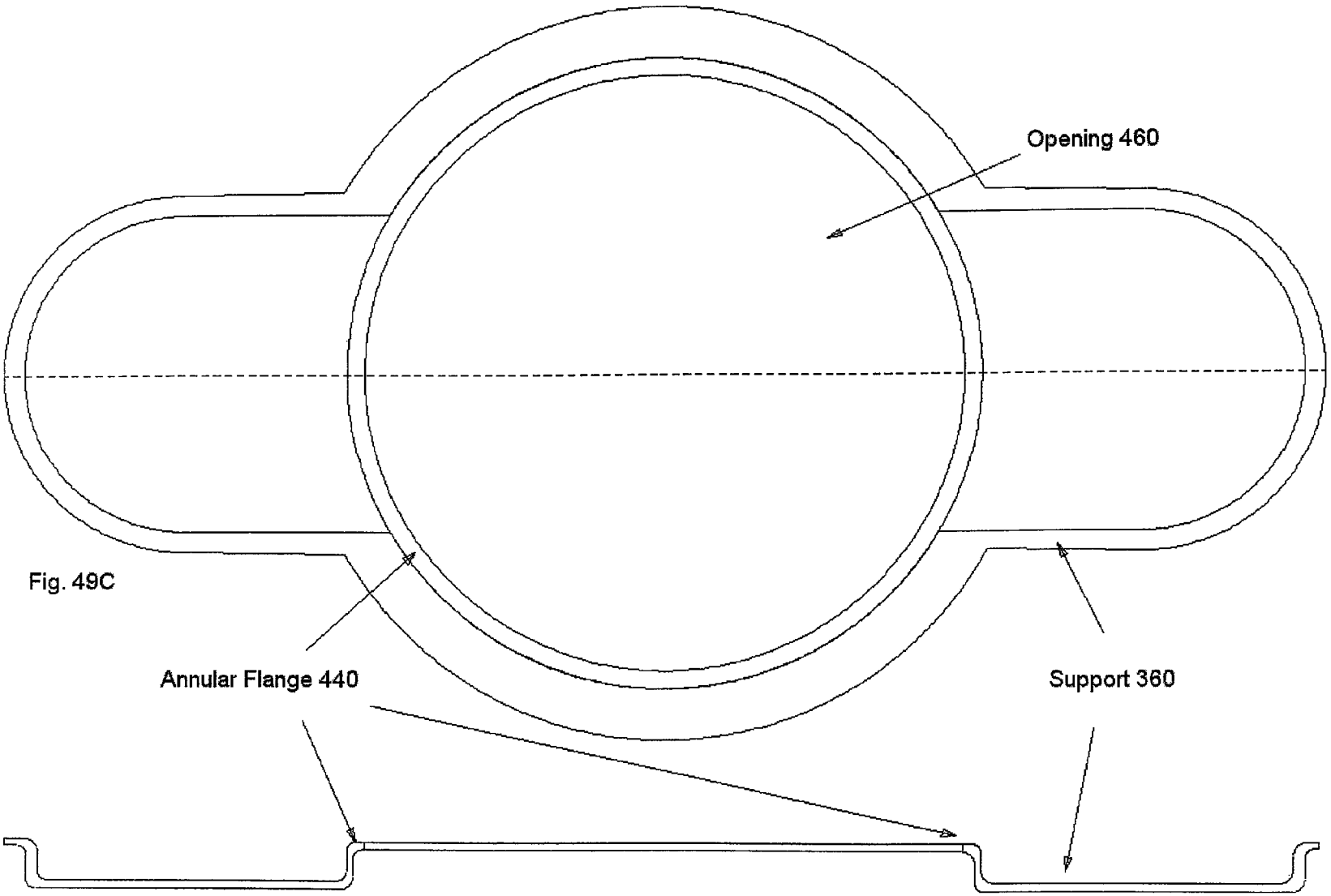
FIG. 49C shows a front plan view of a support for the embodiment shown by FIGS. 49A and 49B.
FIG. 49D shows a cross-sectional view of the support shown in FIG. 49C along the broken line shown therein.
Figures 50D, 50E:
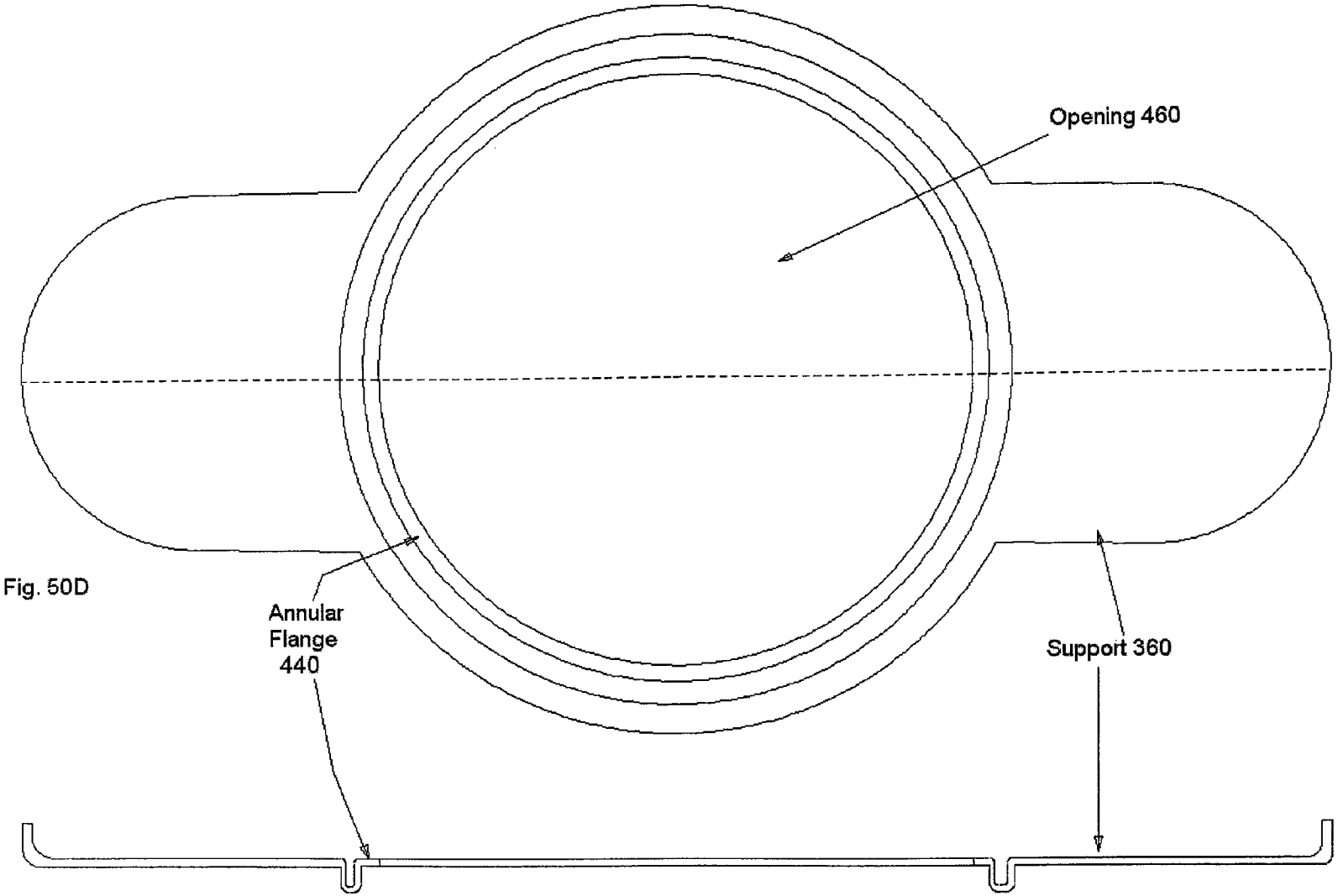
FIG. 50D shows a front plan view of a support for the embodiments shown by FIGS. 50A-50C.
FIG. 50E shows a cross-sectional view of the support shown in FIG. 50D along the broken line shown therein.

The embodiment illustrated by FIG. 48B includes a transmission which is coupled to the exterior surface of back surface of cone 340, and the top edge of each former.

Referring to FIG. 48C, in which like numerals identify like features, transmission 420 may be embedded in the body of either cone 340, or each former 220, or both as illustrated. Thus, for example, a cut may be made in the body of cone 340 and transmission 420 may be received therein and coupled to the body of cone 340. Similarly, a cut may be made in each former 220 and an end of transmission 420 may be received therein and coupled to the body of former 220.

Referring now to FIGS. 49A-49D, in which like numerals identify like features, a loudspeaker driver according to another embodiment includes a support 360 having two oppositely disposed depressions at flange 440 that defines opening 460. A motor 100 is coupled using an adhesive or the like to the bottom of each depression. Consequently, motors 100 are disposed opposite one another at flange 440.

Furthermore, in a driver as depicted by FIGS. 49A-49D cone 340 is assembled such that the interior thereof, upon installation in a speaker cabinet, faces the interior of the cabinet. That is, cone 340 is inverted. Transmission 420 is then coupled to the interior surface of cone 340 as close to the central axis of cone 340. Optionally, and as illustrated, each end of transmission 420 is received in the body of a respective former 220 and coupled thereto as described above. An arrangement according to the present invention may reduce the mounting depth of the driver, and may allow for an increase in the volume of air within the cabinet in that the interior surface of cone 340 would face the interior of the cabinet upon installation of the driver. Note that support 360 includes a flanged peripheral edge that receives mounting holes 400 for the installation of the driver. A seal or the like may be optionally applied to the flanged edge of support 360 in order to prevent/hinder transmission of air into and out of the cabinet once the driver is installed.

Referring now to FIGS. 50A-50B, and 50C-50E, in which like numerals identify like features, a driver according to yet another embodiment includes all features of the first embodiment shown by FIGS. 48A-48C, except that support 360 thereof further includes a ring shaped depression disposed around opening 460 and spaced from annular flange 440. Ring shaped depression extends outwardly, i.e. away from the interior of the cabinet once the driver is installed. The ring shaped depression may add strength to support 360, and may also function as a frame for the installation of a dust cover or the like.

Referring now to FIG. 50C, in which like numerals identify like features, transmission 420 is received in the body of cone 340 and/or the body of formers 220 as described earlier.

In each embodiment, transmission 420 may be coupled to formers 220 and cone 340 using an appropriate adhesive, e.g. an epoxy glue or the like. Similarly, surround 380 may be coupled to support 360 and to cone 340 using appropriate adhesives, and motors 100 can be secured to support 360 using an appropriate adhesive applied to back plate 140 thereof. A cone 340 in a driver according to the present invention may be large, e.g. five inches or more in diameter, and made from pressed paper or any other suitable material including aluminum or a polymer Note that in a driver according to the present invention it is preferred to not have a motor arranged at the back (the side facing the interior of the cabinet) of the diaphragm as is the case in prior art loudspeaker drivers in order to obtain as shallow a profile as possible.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A loudspeaker driver, comprising: at least one movable diaphragm having an open mouth defined by a terminal boundary residing at the outermost lateral edge of said diaphragm surrounding the entire interior surface area of said diaphragm; at least one driver arrangement residing lateral to and outside said open mouth of said one movable diaphragm and including a voice coil movable along a motion axis that is lateral to and outside said outermost lateral edge, said voice coil being suspended in a magnetic field, mechanically coupled to said one movable diaphragm and disposed lateral to said one movable diaphragm; and another movable diaphragm having an open mouth defined by a terminal boundary residing at the outermost lateral edge of said another movable diaphragm surrounding the entire interior surface area of said another movable diaphragm, wherein said motion axis is lateral to and outside said open mouth of said another movable diaphragm and said voice coil is mechanically coupled to said another movable diaphragm.

2. The loudspeaker driver of claim 1, further comprising a transmission body mechanically coupled to said one movable diaphragm, said another movable diaphragm, and said driver arrangement.

3. The loudspeaker driver of claim 1, further comprising a plurality of driver arrangements, at least one of said plurality of driver arrangements residing lateral to and outside said open mouth of said one movable diaphragm and including a voice coil movable along a respective motion axis that is lateral to and outside said outermost lateral edge thereof, said voice coil being suspended in a magnetic field, and mechanically coupled to said one movable diaphragm, and at least another one of said plurality of driver arrangements residing lateral to and outside said open mouth of said another movable diaphragm and including a voice coil movable along a respective motion axis that is lateral to and outside said outermost lateral edge thereof, said voice coil being suspended in a magnetic field, and mechanically coupled to said another movable diaphragm.

4. The loudspeaker driver of claim 3, further comprising a transmission body mechanically coupled to said one movable diaphragm, said another movable diaphragms, said one driver arrangement, and said plurality of driver arrangements.

5. A loudspeaker driver, comprising: a plurality of movable diaphragms laterally spaced from one another, each movable diaphragm having a respective open mouth defined by a respective terminal boundary residing at the outermost lateral edge thereof surrounding the entire interior surface area thereof; and a driving section to drive said movable diaphragms disposed only in said space between said movable diaphragms that includes at least one driver arrangement residing lateral to, and outside said open mouths of said plurality of movable diaphragms and including a voice coil movable along a motion axis that is lateral to and outside said outermost lateral edges of said movable diaphragms, said voice coil being suspended in a magnetic field and mechanically coupled to said movable diaphragms.

6. The loudspeaker driver of claim 5, further comprising a transmission body mechanically coupled to said plurality of movable diaphragms, and said at least one driver arrangement, wherein said transmission body includes terminal free end, each terminal free end directly facing a respective movable diaphragm.

7. The loudspeaker driver of claim 6, wherein said transmission body is bar shaped.

8. The loudspeaker driver of claim 6, wherein said transmission body is cross-shaped.

9. The loudspeaker driver of claim 6, wherein said transmission includes at least three legs each having a terminal free end.

10. The loudspeaker driver of claim 5, wherein said plurality of movable diaphragms are conical.

11. The loudspeaker driver of claim 5, wherein said plurality of movable diaphragms are oval.

12. The loudspeaker driver of claim 5, further comprising another driver arrangement residing between, lateral to, and outside said open mouths of plurality of movable diaphragms and including a voice coil movable along a motion axis that is lateral to and outside said outermost lateral edges of said movable diaphragms, said voice coil being suspended in a magnetic field and mechanically coupled to said movable diaphragms, said another driver arrangement being lateral to said one driver arrangement.

13. A loudspeaker driver, comprising: at least one movable diaphragm having an open mouth defined by a terminal boundary residing at the outermost lateral edge of said diaphragm surrounding the entire interior surface area of said diaphragm; at least one driver arrangement residing lateral to and outside said open mouth of said one movable diaphragm and including a voice coil movable along a motion axis that is lateral to and outside said outermost lateral edge, said voice coil being suspended in a magnetic field, mechanically coupled to said one movable diaphragm and disposed lateral to said one movable diaphragm; and a plurality of movable diaphragms, in addition to said one movable diaphragm, each movable diaphragm of said plurality of movable diaphragms having a respective open mouth defined by a respective terminal boundary residing at the outermost lateral edge thereof surrounding the entire interior surface area thereof, wherein said motion axis is lateral to and outside said open mouths of said plurality of movable diaphragms and said voice coil is mechanically coupled to said plurality of movable diaphragms.

14. The loudspeaker driver of claim 13, further comprising a transmission body mechanically coupled to said one movable diaphragm, said plurality of movable diaphragms, and said driver arrangement.

* * * * *